US009213292B2

(12) United States Patent
Murayama

(10) Patent No.: US 9,213,292 B2
(45) Date of Patent: Dec. 15, 2015

(54) IMAGE FORMING APPARATUS HAVING BEARING BODY AND CLEANING UNIT

(71) Applicant: Brother Kogyo Kabushiki Kaisha, Nagoya-shi, Aichi-ken (JP)

(72) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/285,697

(22) Filed: May 23, 2014

(65) Prior Publication Data

US 2014/0348530 A1 Nov. 27, 2014

(30) Foreign Application Priority Data

May 24, 2013 (JP) ..... 2013-109552

(51) Int. Cl.

*G03G 15/20* (2006.01)
*G03G 15/00* (2006.01)
*G03G 15/16* (2006.01)

(52) U.S. Cl.

CPC ..... *G03G 15/5054* (2013.01); *G03G 15/161* (2013.01); *G03G 15/2003* (2013.01); *G03G 15/2064* (2013.01); *G03G 15/2078* (2013.01); *G03G 15/5004* (2013.01); *G03G 2215/1661* (2013.01); *G03G 2215/2016* (2013.01)

(58) Field of Classification Search

CPC ..... G03G 15/20
USPC ..... 399/71
See application file for complete search history.

(56) References Cited

U.S. PATENT DOCUMENTS

| | | | | |
|---|---|---|---|---|
| 7,650,094 | B2 * | 1/2010 | Yamamoto et al. | 399/71 |
| 7,929,897 | B2 * | 4/2011 | Sugimoto et al. | 399/353 |
| 8,175,471 | B2 * | 5/2012 | Tomita et al. | 399/30 |
| 8,437,657 | B2 * | 5/2013 | Kikuchi et al. | 399/101 |
| 8,682,185 | B2 | 3/2014 | Andou et al. | |
| 2008/0175611 | A1 * | 7/2008 | Tomita et al. | 399/49 |
| 2009/0202263 | A1 * | 8/2009 | Yoshida et al. | 399/49 |
| 2012/0051769 | A1 | 3/2012 | Andou et al. | |
| 2013/0302050 | A1 * | 11/2013 | Shimba et al. | 399/49 |
| 2014/0348530 | A1 * | 11/2014 | Murayama | 399/71 |

FOREIGN PATENT DOCUMENTS

| | | | | |
|---|---|---|---|---|
| JP | 2003-029588 A | | 1/2003 | |
| JP | 2003-140412 | * | 5/2003 | G03G 15/20 |
| JP | 2003-140412 A | | 5/2003 | |
| JP | 2012-053176 A | | 3/2012 | |

* cited by examiner

*Primary Examiner* — Clayton E Laballe
*Assistant Examiner* — Kevin Butler
(74) *Attorney, Agent, or Firm* — Banner & Witcoff, Ltd.

(57) ABSTRACT

In an image forming apparatus, when it is determined that a pre-execution condition is satisfied, a cleaning unit is brought from a first state into a second state and is controlled to clean the bearing body. When it is determined that an execution condition is satisfied, a pattern acquisition is executed to form a pattern image on the bearing body by using an image forming section and to acquire characteristics of the pattern image based on detection results. The pre-execution condition includes a condition that a correlation value satisfies a first condition. The correlation value is correlated with an amount of deviation in characteristics of images formed by the image forming section. The execution condition includes a condition that the correlation value satisfies a second condition. The correlation value satisfies the first condition before satisfying the second condition.

14 Claims, 7 Drawing Sheets

IMAGE FORMING APPARATUS HAVING BEARING BODY AND CLEANING UNIT

CROSS REFERENCE TO RELATED APPLICATION

This application claims priority from Japanese Patent Application No. 2013-109552 filed May 24, 2013. The entire content of this priority application is incorporated herein by reference.

TECHNICAL FIELD

The present invention relates to a technology for cleaning a bearing body such as a belt provided in an image forming apparatus.

BACKGROUND

There has been conventionally proposed an image forming apparatus having a function for cleaning a transfer belt. This image forming apparatus has the transfer belt, a detection sensor, and a cleaning unit. In the image forming apparatus, an image for density detection is formed on a conveyance surface of the transfer belt. Based on detection results of the density detection image by the density sensor, image density of the density detection image is acquired. Next, the cleaning unit is used to clean the conveyance surface of the transfer belt. Thereafter, based on detection results of the conveyance surface of the transfer belt by the density sensor, it is determined whether the conveyance surface of the transfer belt needs to be cleaned moreover. When it is determined that the transfer belt needs to be cleaned moreover, the cleaning unit is used again to clean the conveyance surface of the transfer belt.

SUMMARY

When a pattern image, such as the density detection image, is formed on a bearing body, such as the transfer belt, substances, such as coloring agent and fragments of sheets, may have been adhered onto the bearing body. In such a case, acquisition accuracy of the pattern image will be deteriorated.

In the above-described conventional image forming apparatus, the transfer belt is cleaned immediately after the density detection image is detected. So, substances may possibly be adhered onto the transfer belt until the density detection image is formed for the next time. In such a case, the acquisition accuracy of the density detection image will be deteriorated.

In view of the foregoing, it is an object of the invention to provide a technology that can restrain deterioration in the acquisition accuracy of a pattern image that will possibly occur due to substances adhered to the bearing body.

In order to attain the above and other objects, the invention may provide an image forming apparatus. The image forming apparatus may include: a bearing body; an image forming section; a detection unit; a cleaning unit; and a control device. The image forming section may be configured to form an image on the bearing body. The detection unit may be configured to output detection results that correspond to a state of a surface of the bearing body. The cleaning unit may be configured to clean the bearing body. The cleaning unit may be configured to be brought into a first state and a second state different from the first state. The cleaning unit in the first state may attain a first cleaning performance level. The cleaning unit in the second state may attain a second cleaning performance level that is higher than the first cleaning performance level. The control device may be configured to: execute a pre-execution condition determination to determine whether a pre-execution condition is satisfied; when it is determined that the pre-execution condition is satisfied, bring the cleaning unit from the first state into the second state and control the cleaning unit to clean the bearing body; execute an execution condition determination to determine whether an execution condition is satisfied; and when it is determined that the execution condition is satisfied, execute a pattern acquisition for forming a pattern image on the bearing body by using the image forming section and acquiring characteristics of the pattern image based on detection results that are outputted from the detection unit by detecting the pattern image. The pre-execution condition may include a condition that a correlation value satisfies a first condition. The correlation value may be correlated with an amount of deviation in characteristics of images formed by the image forming section. The execution condition may include a condition that the correlation value satisfies a second condition. The correlation value may satisfy the first condition before satisfying the second condition.

According to another aspect, the present invention may provide a method of controlling an image forming apparatus. The image forming apparatus may include: a bearing body; an image forming section configured to form an image on the bearing body; a detection unit configured to output detection results that correspond to a state of a surface of the bearing body; and a cleaning unit configured to clean the bearing body, the cleaning unit being configured to be brought into a first state and a second state different from the first state, the cleaning unit in the first state attaining a first cleaning performance level, the cleaning unit in the second state attaining a second cleaning performance level that is higher than the first cleaning performance level. The method may include: executing a pre-execution condition determination to determine whether a pre-execution condition is satisfied; when it is determined that the pre-execution condition is satisfied, bringing the cleaning unit from the first state into the second state and controlling the cleaning unit to clean the bearing body; executing an execution condition determination to determine whether an execution condition is satisfied; and when it is determined that the execution condition is satisfied, executing a pattern acquisition for forming a pattern image on the bearing body by using the image forming section and acquiring characteristics of the pattern image based on detection results that are outputted from the detection unit by detecting the pattern image. The pre-execution condition may include a condition that a correlation value satisfies a first condition. The correlation value may be correlated with an amount of deviation in characteristics of images formed by the image forming section. The execution condition may include a condition that the correlation value satisfies a second condition. The correlation value may satisfy the first condition before satisfying the second condition.

According to still another aspect, the present invention may provide a non-transitory computer readable storage medium storing a set of program instructions installed on and executed by a computer for controlling an image forming apparatus. The image forming apparatus may include: a bearing body; an image forming section configured to form an image on the bearing body; a detection unit configured to output detection results that correspond to a state of a surface of the bearing body; and a cleaning unit configured to clean the bearing body, the cleaning unit being configured to be brought into a first state and a second state different from the first state, the cleaning unit in the first state attaining a first cleaning performance level, the cleaning unit in the second state attaining a second cleaning performance level that is higher than the first cleaning performance level. The program instructions may include: executing a pre-execution condition determination to determine whether a pre-execution condition is satisfied; when it is determined that the pre-execution condition is satisfied, bringing the cleaning unit from the first state into the second state and controlling the cleaning unit to clean the bearing body; executing an execution condition determination to determine whether an execution condition is satisfied; and when it is determined that the execution condition is satisfied, executing a pattern acquisition for forming a pattern image on the bearing body by using the image forming section and acquiring characteristics of the pattern image based on detection results that are outputted from the detection unit by detecting the pattern image. The pre-execution condition may include a condition that a correlation value satisfies a first condition. The correlation value may be correlated with an amount of deviation in characteristics of images formed by the image forming section. The execution condition may include a condition that the correlation value satisfies a second condition. The correlation value may satisfy the first condition before satisfying the second condition.

BRIEF DESCRIPTION OF THE DRAWINGS

The particular features and advantages of the invention as well as other objects will become apparent from the following description taken in connection with the accompanying drawings, in which.

DETAILED DESCRIPTION

An Embodiment

Figure 1:
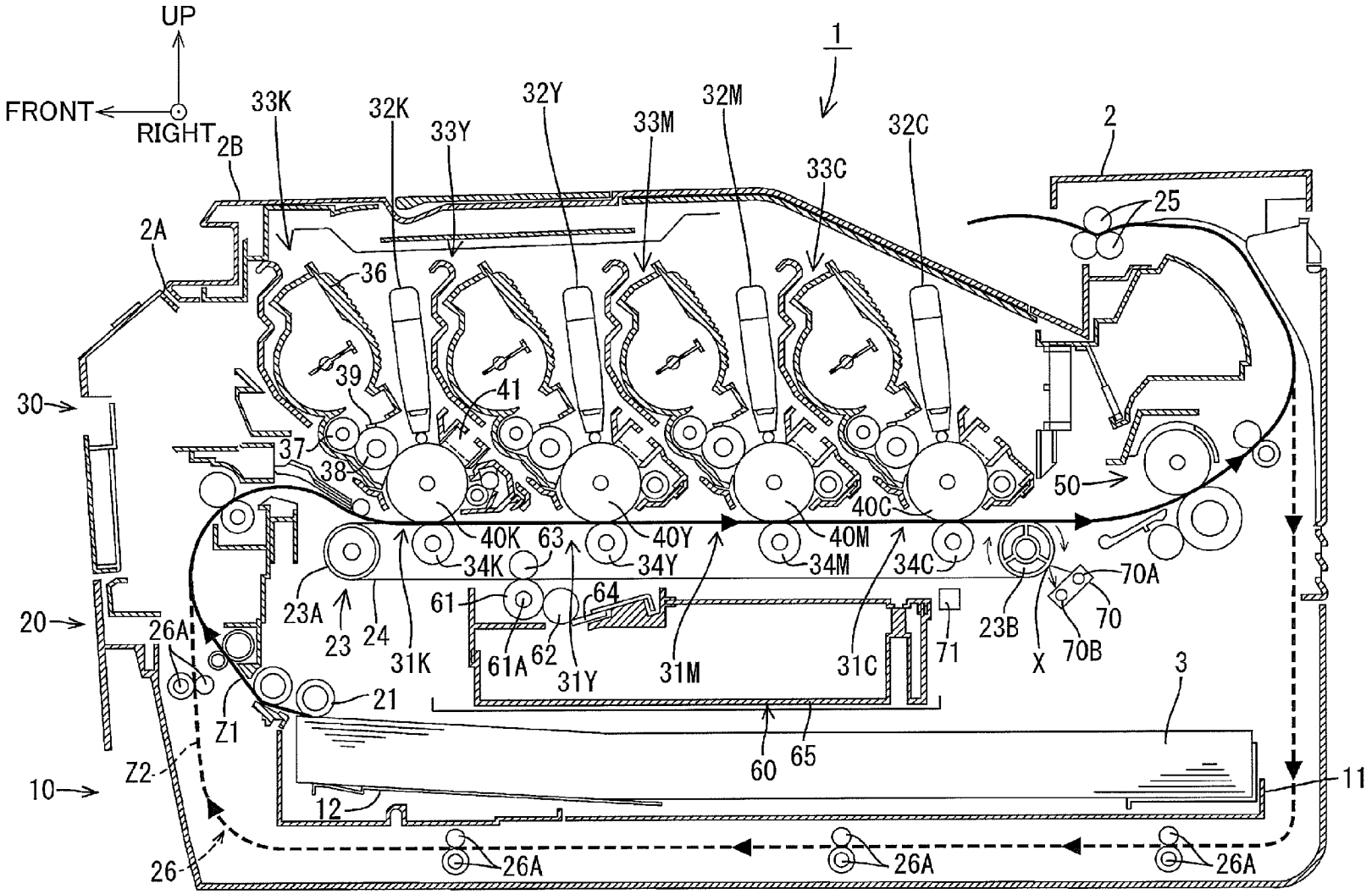
FIG. 1 schematically shows the configuration of a printer according to an embodiment of the present invention.

A printer 1 according to an embodiment of the present invention will be described with reference to FIGS. 1 to 7.

Directions used in the following description in relation to the printer 1 will reference the state of the printer 1 when the printer 1 is resting on a horizontal surface. More specifically, the left side in FIG. 1 will be referred to as the "front side of the printer 1," and the upper side in FIG. 1 as the "upper side of the printer 1," as indicated by the arrows in FIG. 1. Further, left and right sides of the printer 1 in the following description will be based on the perspective of the user facing the front side of the printer 1. Thus, the near side of the printer 1 in FIG. 1 will be considered the "right side of the printer 1," as also indicated by the arrows in FIG. 1.

The printer 1 is a direct-to-paper transfer tandem type printer. The printer 1 has a structure capable of performing both of single-sided printing and double-sided printing. The single-sided printing is for forming an image on a single surface of a sheet 3. The double-sided printing is for forming images on both front and back surfaces of a sheet 3. In addition, this printer 1 is capable of forming color images using toner in four colors black, yellow, magenta, and cyan. Incidentally, in order to discriminate between constituent parts of and terms related to the printer 1 in the respective colors, reference numerals for these parts and terms are suffixed with K (black), Y (yellow), M (magenta), and C (cyan).

The printer 1 is an example of an image forming apparatus. The single-sided printing is an example of single-sided image formation. The double-sided printing is an example of double-sided image formation.

(Overall Structure of Printer)

As shown in FIG. 1, the printer 1 includes, within a casing 2, a sheet accommodating unit 10, a conveyance unit 20, and an image forming section 30.

The casing 2 is as a whole formed into a substantially box-like shape. The casing 2 has an upper surface portion into which an opening 2A is formed. The casing 2 has a cover 2B. The cover 2B has a rear end side that is rotatably connected to the casing 2. The cover 2B can be displaced between a closed posture, thereby closing the opening 2A (see FIG. 1), and an open posture, thereby opening the opening 2A. By placing the cover 2B in the open posture, a belt unit 23 and processing units 33K to 33C can be replaced.

The sheet accommodating unit 10 is disposed at a bottom portion within the casing 2. The sheet accommodating unit 10 includes a tray 11 and a push-up member 12. The tray 11 is capable of accommodating a stack of a plurality of sheets 3 therein. The sheets 3 are, for example, sheets of paper or overhead projector sheets. The push-up member 12 is provided in the tray 11, and is configured to push upward a front side portion of the sheets 3 accommodated in the tray 11.

The conveyance unit 20 includes a pickup roller 21, the belt unit 23, discharge rollers 25, and a reversal mechanism 26. The pickup roller 21 is disposed upward of a front end of the tray 11. The pickup roller 21 comes into contact with an upper surface of a frontward portion of the sheets 3 that have been pushed upward by the push-up member 12. The pickup roller 21 is driven to rotate, thereby conveying the topmost of the sheets 3 loaded in the tray 11 one by one toward the belt unit 23.

The belt unit 23 has a pair of supporting rollers 23A and 23B, and a belt 24. The belt 24 constitutes a loop and is mounted on and around the pair of supporting rollers 23A and 23B in a taut state. The rearward supporting roller 23B is driven to rotate by a drive motor 20A (see FIG. 2), and thereby the belt 24 rotationally moves clockwise in FIG. 1, and conveys rearward the sheet 3 placed on an upper surface of the belt 24. The belt 24 is an example of a bearing body and of a rotating body. The supporting roller 23B and the drive motor 20A are examples of a driving unit.

The belt 24 is made of polycarbonate resin material, for example. A surface of the belt 24 is subjected to mirror finishing. The belt 24 has an interior side at which are disposed four transfer rollers 34K to 34C. The transfer rollers 34K to 34C are constituents of the image forming section 30. The respective transfer rollers 34K to 34C are disposed so as to oppose photosensitive bodies 40K to 40C of corresponding process units 33K to 33C, with the belt 24 interposed therebetween. The process units 33K to 33C will be described later The discharge rollers 25 are disposed at the upper surface of the casing 2. The discharge rollers 25 are capable of performing forward rotation to deliver sheets 3 conveyed from the belt 24 out toward the upper surface of the casing 2, and of performing reverse rotation to return sheets 3 back into the casing 2 again. The reversal mechanism 26 includes multiple reverse conveying rollers 26A disposed downward of the tray 11. The reversal mechanism 26 conveys the sheets 3 that have been returned into the casing 2 by the reverse rotation of the discharge rollers 25, while reversing the front and back surfaces of the sheets 3, and delivers the sheets 3 onto the belt 24 again. In FIG. 1, solid arrows indicate a forward conveyance path Z1 along which the sheets 3 are guided from the tray 11 via the belt 24 to the discharge rollers 25. Dashed arrows indicate a reverse conveyance path Z2 along which the sheets 3 are guided by the reversal mechanism 26 from the discharge rollers 25 onto the belt 24, while being reversed in their front and back surfaces.

The image forming section 30 is disposed upward of the belt unit 23. The image forming section 30 includes four image forming units 31K, 31Y, 31M, and 31C corresponding to the respective colors black, yellow, magenta, and cyan, and a fixing unit 50. The four image forming units 31K, 31Y, 31M, and 31C are arrayed in the conveyance direction of the belt 24, that is, in the front-rear direction.

The four image forming units 31K, 31Y, 31M, and 31C differ only in toner color, and are otherwise identical in terms of structure and operation. The structure and operation of the image forming unit 31K will now be described below. The image forming unit 31K is configured to form toner images on the belt 31 or on sheets 3. The image forming unit 31K has an exposure unit 32K, the process unit 33K, and the transfer roller 34K.

The exposure unit 32K has multiple LEDs (not shown). These LEDs are arrayed in a single line in a left-right direction. In the printer 1, the left-right direction is a main scanning direction, and the front-rear direction is a sub scanning direction. The exposure unit 32K carries out exposure by having the LEDs radiate light onto a surface of the opposing photosensitive body 40K, with light emission controlled based on image data for an image to be formed.

The process unit 33K has a toner accommodating chamber 36, a supply roller 37, a developing roller 38, and a thickness regulating blade 39. The toner accommodating chamber 36 is configured to accommodate black toner which constitutes a coloring agent. The developing roller 28 is applied with a developing bias by an application circuit (not shown). The toner in the toner accommodating chamber 36 is supplied onto the supply roller 37. As the toner is supplied from the supply roller 37 to the developing roller 38, the toner is tribocharged to a positive polarity between the supply roller 37 and the developing roller 38. The toner on the developing roller 38 is further tribocharged between the developing roller 38 and the thickness regulating blade 39, and is regulated into a layer of uniform thickness. The printer 1 can change the developing bias, which the application circuit applies to the developing roller 38, by changing a bias correction value as will be described later. The toner accommodating chamber 36 is an example of an accommodating part.

The process unit 33K further has the photosensitive body 40K and a scorotron charger 41. The photosensitive body 40K is covered by a photosensitive layer, whose surface has positive charging characteristics. When the printer 1 performs a print processing and various types of acquisition processings to be described later, the photosensitive body 40K is driven to rotate, and the surface of the photosensitive body 40K is uniformly positively charged. The positively-charged portion is then exposed by the exposure unit 32K, as a result of which an electrostatic latent image is formed on the surface of the photosensitive body 40K. The photosensitive body 40K is an example of an image bearing body.

Next, the toner on the developing roller 38 is supplied to the electrostatic latent image, thereby transforming the electrostatic latent image into a visible image, and thus forming a toner image. As the sheet 3 passes through successive transfer locations between the photosensitive body 40K and the transfer roller 34K, the toner image carried on the surface of the photosensitive body 40K is sequentially transferred onto the sheet 3 by a transfer voltage of negative polarity applied to the transfer roller 34K. The sheet 3 onto which the toner image has been transferred is then conveyed to the fixing unit 50, where the toner image is thermally fixed. The sheet 3 is then conveyed upward and discharged onto the upper surface of the casing 2.

When double-sided printing is executed, the sheet 3 is delivered from the tray 11 onto the belt 24, and images are formed by the image forming section 30 on the back surface of the sheet 3, that is, the surface of the sheet 3 that faced downwardly when the sheet 3 was accommodated in the tray 11. Thereafter, the sheet 3 is delivered to the discharge rollers 25. Then, as a result of the reverse rotation of the discharge rollers 25, the sheet 3 is conveyed by the reverse conveying rollers 26A and is delivered onto the belt 24 again with the front and back surfaces thereof reversed. Images are then formed by the image forming section 30 on the front surface of the sheet 3, that is, the surface of the sheet 3 that faced upwardly when the sheet 3 was accommodated in the tray 11. The sheet 3 is then discharged to the upper surface of the casing 2.

The printer 1 further includes, within the casing 2, a cleaning unit 60, a mark sensor 70, and a humidity sensor 71. The cleaning unit 60 is disposed downward of the belt unit 23. The cleaning unit 60 serves to electrically attract and recover adhered substances such as adhered toner and paper dust that have adhered to the surface of the belt 24. It is noted that the adhered substances include a pattern for position acquisition and a pattern for density acquisition to be described later. The cleaning unit 60 has a cleaning roller 61, a recovery roller 62, a backup roller 63, a cleaning blade 64, and a reservoir box 65.

The cleaning roller 61 includes: a shaft member 61A extending in the left-right direction; and a foam material made of silicone and provided on the outer periphery of the shaft member 61A. The backup roller 63 is made of metal, and is disposed so as to oppose the cleaning roller 61 with the belt 24 interposed between the backup roller 63 and the cleaning roller 61. The backup roller 63 is electrically connected to a ground line (not shown).

The cleaning roller 61 is driven to rotate, while being in contact with the belt 24, so that the cleaning roller 61 moves in a direction opposite to that of the belt 24 at the area where the cleaning roller 61 contacts the belt 24. The cleaning roller 61 is configured to be applied with a first cleaning voltage. When the first cleaning voltage applied to the cleaning roller 61 reaches a first target level, the cleaning roller 61 becomes capable of electrically attracting substances adhered to the belt 24, thereby cleaning the surface of the belt 24. It is noted that the polarity of the first target level is opposite to that of the toner. An example of the first target level is −1,200 volts (V).

The recovery roller 62 is made of metal. For example, the recovery roller 72 may be made of nickel-plated iron, or made of stainless steel. The recovery roller 62 is in contact with the cleaning roller 61. The recovery roller 62 is configured to be applied with a second cleaning voltage. When the second cleaning voltage applied to the recovery roller 62 reaches a second target level, the recover roller 62 becomes capable of electrically attracting substances adhered to the cleaning roller 61, thereby recovering the adhered substances from the cleaning roller 61. It is also noted that polarity of the second target level is opposite to that of the toner. An example of the second target level is −1,600 volts (V).

The cleaning blade 64 is made of rubber, for example. The cleaning blade 64 is in abutment contact with the recovery roller 62, and is configured to scrape off substances that have adhered to the recovery roller 62. The adhered substances that are scraped off by the cleaning blade 64 are accumulated in the reservoir box 65.

The mark sensor 70 is configured to output detection results that correspond to a state of a surface of the belt 24. More specifically, the mark sensor 70 is an optical sensor, and includes: a light projection part 70A for projecting light toward a detection location X defined on the surface of the belt 24; and a light reception part 70B for receiving light reflected from the detection location X. The state of the surface of the belt 24 changes depending on the degree of adhesion of substances on the belt 24. The state of the surface of the belt 24 therefore changes also depending on positions and image densities of the pattern image formed on the belt 24. The humidity sensor 71 is configured to detect humidity within the casing 2, and to output detection results to a controller 80. The mark sensor 70 is an example of a detection unit. The humidity sensor 71 is an example of a humidity detection unit.

Electrical Structure of Printer

Figure 2:
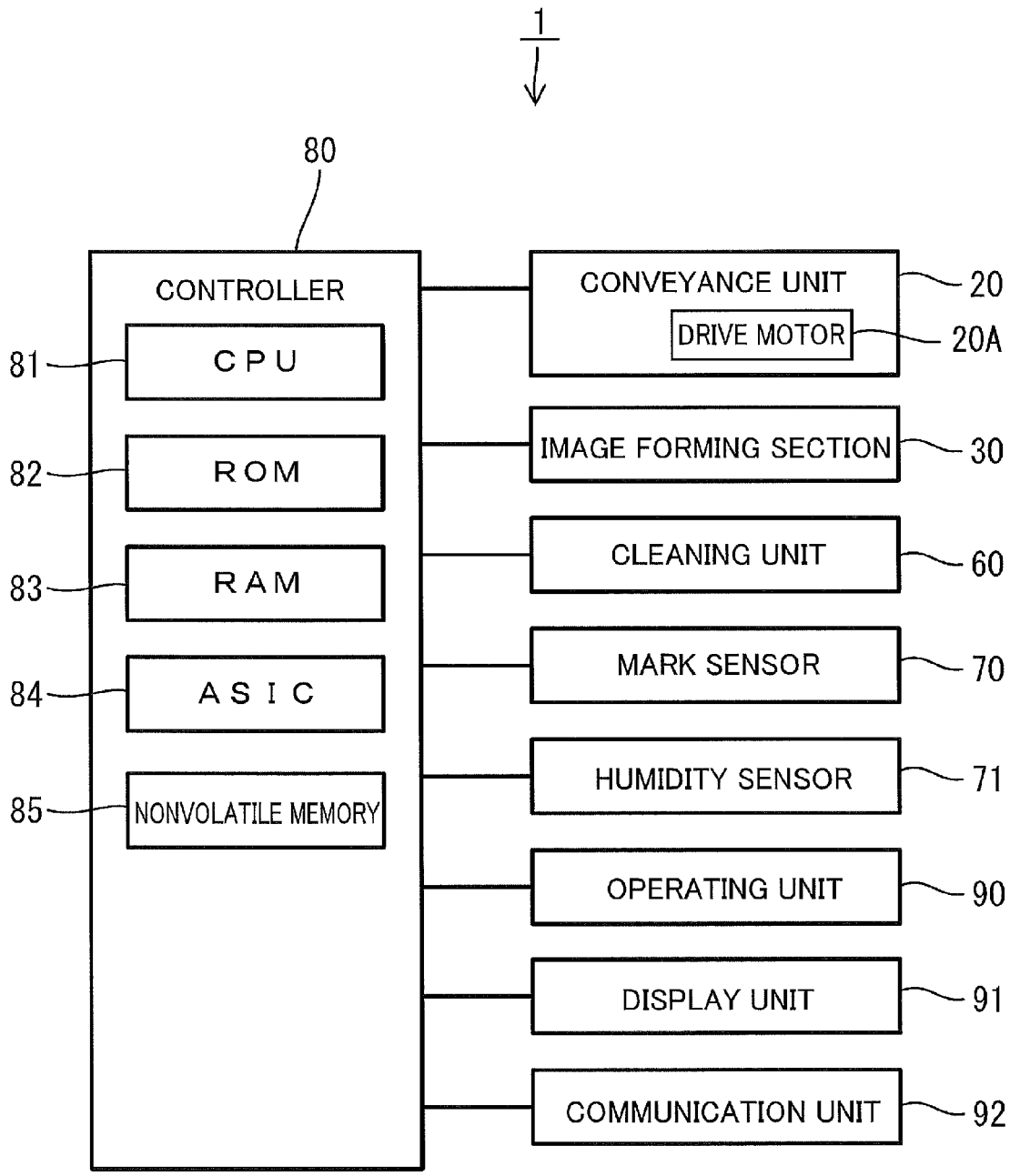
FIG. 2 is a block diagram schematically showing an electrical structure of the printer.

As shown in FIG. 2, the printer 1 includes the conveyance unit 20, the image forming section 30, the cleaning unit 60, the mark sensor 70, and the humidity sensor 71, as well as the controller 80, an operating unit 90, a display unit 91, and a communication unit 92.

The controller 80 has a CPU (central processing unit) 81, a ROM 82, a RAM 83, an ASIC (Application Specific Integrated Circuit) 84, and a nonvolatile memory 85. The ROM 82 stores programs for executing a print control processing and a cleaning-and-correction control processing according to the present embodiment to be described later, and programs for performing other various operations of the printer 1. The CPU 81 controls various parts of the printer 1 in accordance with programs read from the ROM 82 into the RAM 83. Instead of being stored in the ROM 82, the programs may be stored in a nonvolatile memory such as a CD-ROM, a hard disk device, or a flash memory. The ASIC 84 is a hardware circuit such as a dedicated image processing circuit. The nonvolatile memory 85 stores a position execution threshold αth and a density execution threshold βth, which will be described later.

The operating unit 90 is equipped with various buttons. The operating unit 90 is configured to allow a variety of input operations to be performed by a user. The operating unit 90 is configured to send to the controller 80 operating signals that correspond to the input operations of the user. The display unit 91 is provided with a liquid crystal display and various lights. The display unit 91 is configured to display a variety of configuration screens and operating states of the printer 1. The communication unit 92 is configured to perform mutual data communication with external information processing devices (not shown), such as personal computers, over wired or wireless communication lines. The operating unit 90 and the communication unit 92 are examples of a reception unit.

Various Types of Pattern Acquisition Processing, and Execution and Pre-Execution Conditions The controller 80 executes a position acquisition processing and a density acquisition processing, as described below.

(1) Position Acquisition Processing

A position acquisition execution condition is set for the printer 1. That is, the printer 1 is configured to execute the position acquisition processing when the printer 1 satisfies the position acquisition execution condition. In the position acquisition processing, the printer 1 forms a prescribed pattern for position acquisition (not shown) on the belt 24 by using the image forming section 30. The printer 1 acquires positions in the sub scanning direction of respective marks constituting the position acquisition pattern (which will be referred to simply as image forming positions) based on detection results which the mark sensor 70 has outputted by detecting the position acquisition pattern. The position acquisition processing is an example of a pattern acquisition, and the positions in the sub scanning direction of the marks constituting the position acquisition pattern are an example of characteristics of a pattern image.

The printer 1 needs to satisfy the position acquisition execution condition, in order to execute the position acquisition processing. The position acquisition execution condition includes such a condition that a position correlation value becomes greater than or equal to a position execution threshold. The position correlation value is correlated with an amount of deviation in positions of images formed by the image forming section 30 relative to ideal positions. In this example, the printer 1 satisfies the position acquisition execution condition if the printer 1 satisfies such a condition that a total sheet count α has become greater than or equal to a position execution threshold αth. The total sheet count α is the number of sheets 3 on which printing has been performed since the last time that the position acquisition processing was carried out. In other words, the total sheet count α is the number of printed sheets 3 that has been counted since the last time that the position acquisition processing was carried out. The total sheet count α will be referred to simply as printed sheet count α hereinafter. The printed sheet count α and the position execution threshold αth are stored in the nonvolatile memory 85. The position acquisition execution condition is an example of an execution condition. The printed sheet count α is an example of a correlation value and of a position correlation value, and the position execution threshold αth is an example of an execution threshold and of a position execution threshold.

A position pre-execution condition is also set for the printer 1. The printer 1 satisfies the position pre-execution condition earlier than the printer 1 satisfies the position acquisition execution condition. In this example, the printer 1 satisfies the position pre-execution condition if the printer 1 satisfies both of the following conditions A and B:

Condition A: That the printed sheet count α becomes greater than or equal to a position pre-execution threshold αths, which is smaller than the position execution threshold αth. In this example, the position pre-execution threshold αths has such a value that is obtained by multiplying the position execution threshold αth by a coefficient which is smaller than 1. The coefficient is preferably larger than 0.5. In this example, the coefficient is equal to 0.8. Or, the position pre-execution threshold αths may be obtained by subtracting a prescribed value from the position execution threshold αth.

Condition B: That a degree of adhesion of substances on the belt 24 exceeds an adhesion threshold, which will be described later.

The position pre-execution condition is an example of a pre-execution condition. The position pre-execution threshold αths is an example of a pre-execution threshold and of a position pre-execution threshold.

(2) Density Acquisition Processing

A density acquisition execution condition is also set for the printer 1. The printer 1 is configured to execute the density acquisition processing when the printer 1 satisfies the density acquisition execution condition. In the density acquisition processing, the printer 1 forms a prescribed pattern for density acquisition (not shown) on the belt 24 by using the image forming section 30. The printer 1 acquires image densities of respective marks constituting the density acquisition pattern (which will be referred to simply as image densities) based on detection results which the mark sensor 70 has outputted by detecting the density acquisition pattern. The density acquisition processing is an example of a pattern acquisition, and the image densities of the marks constituting the density acquisition pattern are an example of characteristics of a pattern image.

The printer 1 needs to satisfy the density acquisition execution condition, in order to execute the density acquisition processing. The density acquisition execution condition includes such a condition that a density correlation value becomes greater than or equal to a density execution threshold. The density correlation value is correlated with an amount of deviation in image densities of images formed by the image forming section 30 relative to ideal image densities. In this example, the printer 1 satisfies the density acquisition execution condition if the printer 1 satisfies such a condition that a humidity β detected by the humidity sensor 71 has become higher than or equal to a density execution threshold βth. The humidity β and the density execution threshold βth are stored in the nonvolatile memory 85. The density acquisition execution condition is an example of an execution condition. The humidity β is an example of a correlation value and of a density correlation value, and the density execution threshold βth is an example of an execution threshold and of a density execution threshold.

A density pre-execution condition is also set for the printer 1. The printer 1 satisfies the density pre-execution condition earlier than the printer 1 satisfies the density acquisition execution condition. In this example, the printer 1 satisfies the density pre-execution condition if the printer 1 satisfies both of the following condition C and the condition B described above.

Condition C: That the humidity β becomes higher than or equal to a density pre-execution threshold βths, which is lower than the density execution threshold βth. In this example, the density pre-execution threshold βths has such a value that is obtained by multiplying the density execution threshold βth by a coefficient which is smaller than 1. The coefficient is preferably larger than 0.5. In this example, the coefficient is equal to 0.8. Or, the density pre-execution threshold βths may be obtained by subtracting a prescribed value from the density execution threshold βth.

The density pre-execution condition is an example of a pre-execution condition. The density pre-execution threshold βths is an example of a pre-execution threshold and of a density pre-execution threshold.

Print Control Processing

Figure 3:
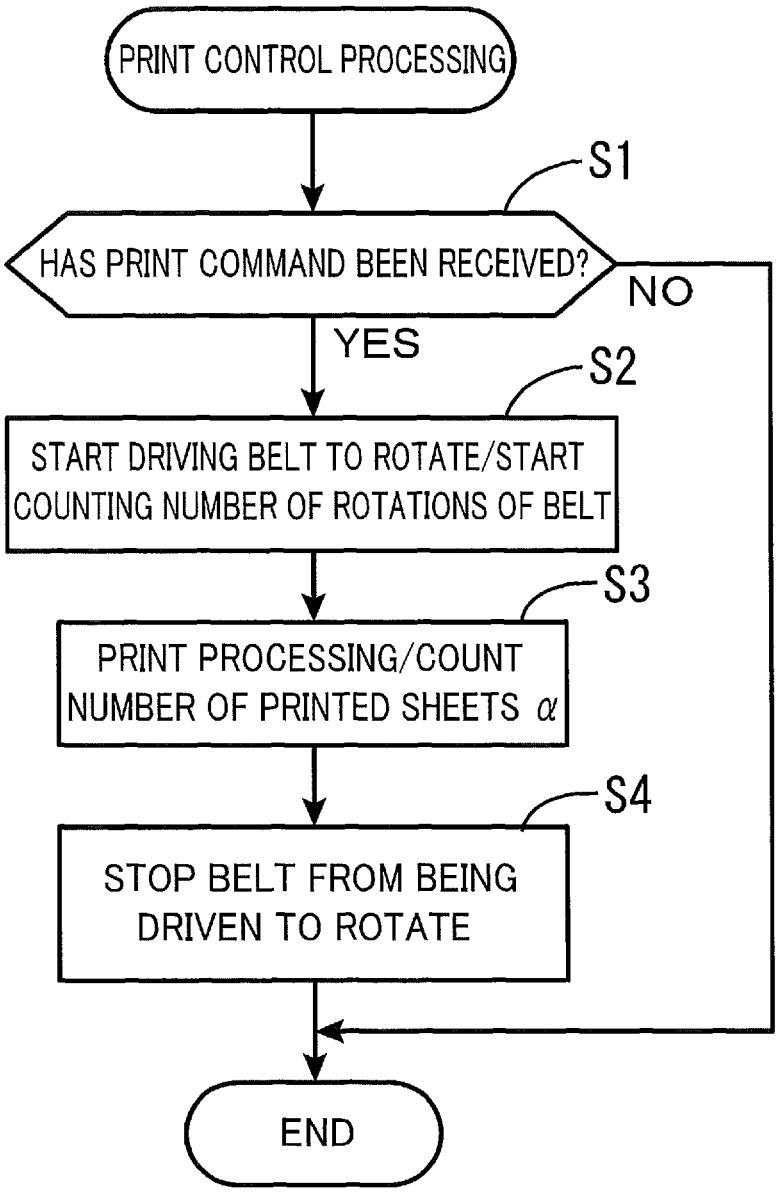
FIG. 3 is a flowchart of a print control processing according to the embodiment.

When the printer 1 is powered on, the controller 80 executes print control processing shown in FIG. 3 repeatedly at prescribed time intervals.

First, in S1 the CPU 81 determines whether or not the operating unit 90 or the communication unit 92 has received a print command. Print commands include print data for images specified by the user, and print conditions information such as whether to perform single-side or double-sided printing. The CPU 81 is capable of determining, based on the operating signals from the operating unit 90, whether or not the operating unit 90 received a print command as a result of user input operations. The CPU 81 is also capable of determining, based on the signals from the communication unit 92, whether or not the communication unit 92 received a print command from an information processing device. Print commands are an example of formation commands.

If the CPU 81 determines that a print command has not been received (S1: NO), the CPU 81 terminates the print control processing, and starts print control processing again after a prescribed period of time has passed. On the other hand, if the CPU 81 determines that a print command has been received (S1: YES), in S2 the CPU 81 causes the belt 24 to start being driven to rotate. In addition, in S2 the CPU 81 starts to count the number of rotations of the belt 24, in order to determine the total number of rotations that have occurred since the printer 1 was new, that is, since the printer 1 was shipped. The CPU 81 is capable of counting the number of rotations of the belt 24 based on a length of time during which the drive motor 20A is driving. The printer 1 may be provided with a rotation count sensor (not shown) for detecting the number of rotations of the belt 24. In such a case, the CPU 81 may count the number of rotations of the belt 24 based on the detection results of the rotation count sensor.

When sheets 3 are conveyed onto the belt 24, in S3 the CPU 81 executes print processing to print images on the sheets 3 based on the print data contained in the print command. In addition, in S3 the CPU 81 counts the number of sheets 3 that have been printed over the course of this print processing, and adds this counted result to the printed sheet count α.

If single-sided printing is specified in the print conditions information, the CPU 81 causes the image forming section 30 to execute single-sided printing. On the other hand, if double-sided printing is specified in the print conditions information, the CPU 81 causes the image forming section 30 to execute double-sided printing. When the print processing has completed, the CPU 81 stops the belt 24 from being driven to rotate in S4, and terminates this print control processing. The CPU 81 starts the print control processing again after a prescribed time period has passed. The processing in S2 and S3 is an example of image formation.

Cleaning-and-Correction Control Processing

Figure 4:
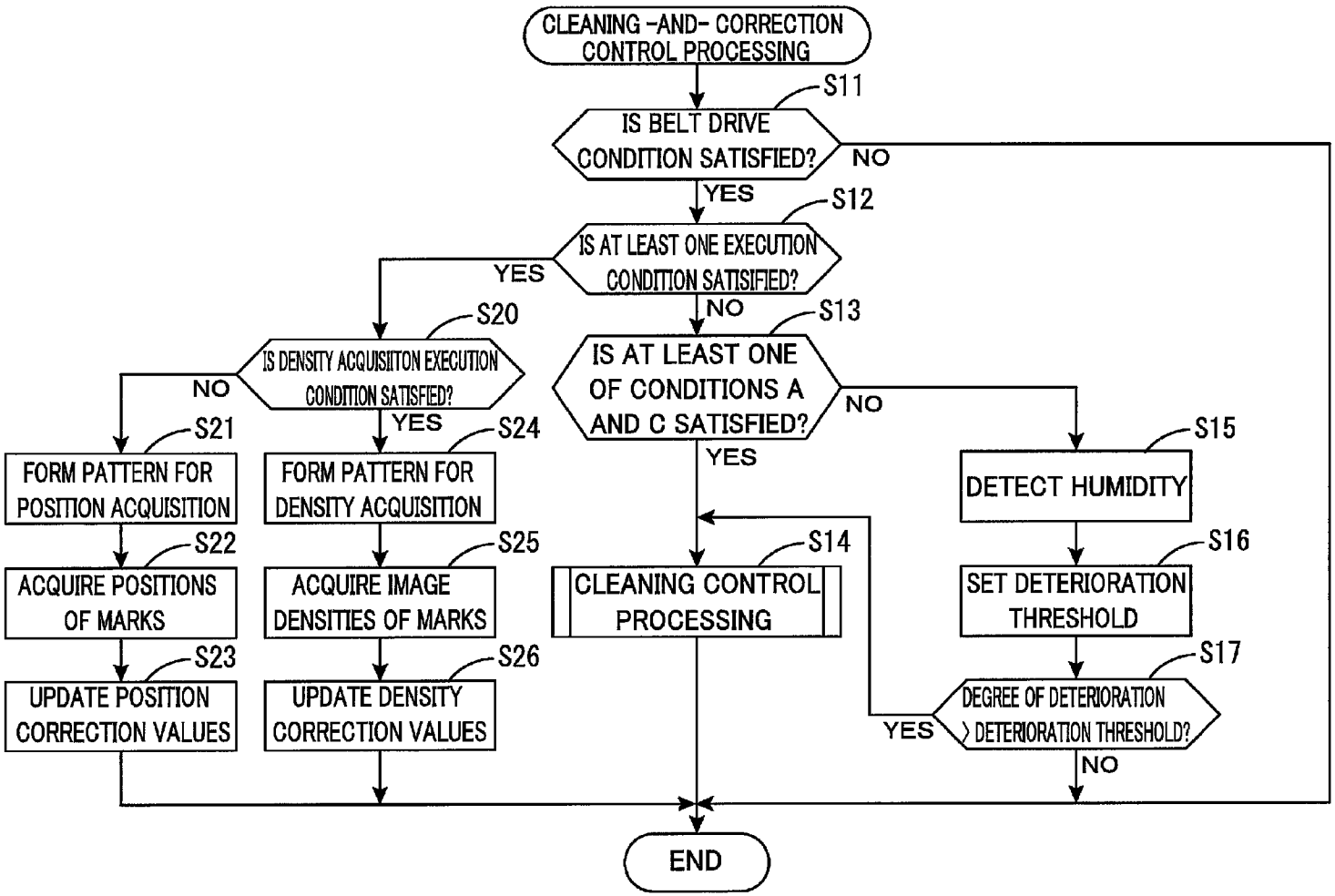
FIG. 4 is a flowchart of a cleaning-and-correction control processing according to the embodiment.
Figure 5:
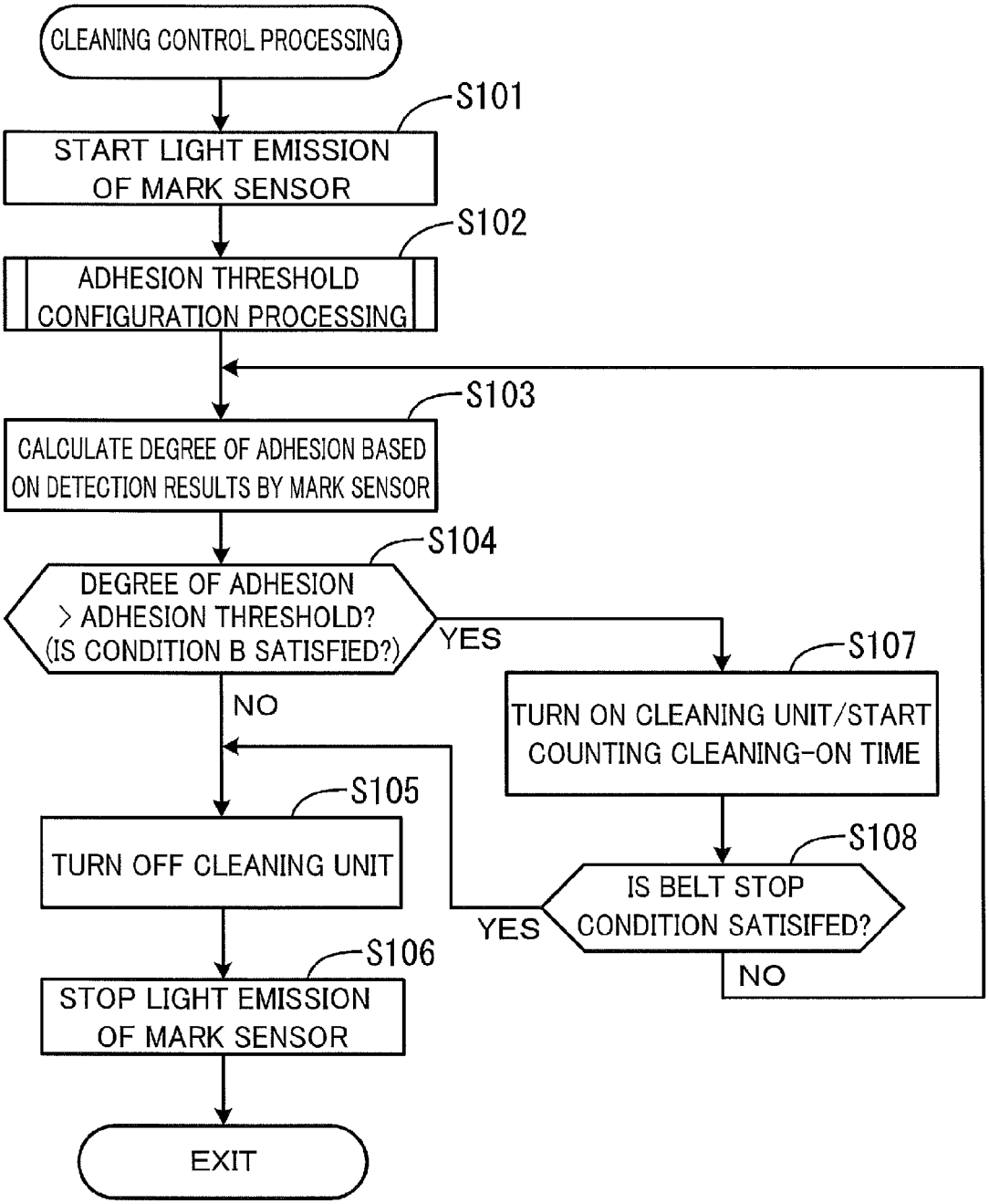
FIG. 5 is a flowchart of a cleaning control processing shown in FIG. 4.

When the printer 1 is powered on, the controller 80 also executes a cleaning-and-correction control processing shown in FIG. 4 repeatedly at prescribed time intervals. Thus, the controller 80 executes the cleaning-and-correction control processing in parallel with the print control processing. By executing the cleaning-and-correction control processing, the cleaning unit 60 can clean the belt 24 in advance, that is, before the printer 1 satisfies the position acquisition execution condition or the density acquisition execution condition. This can prevent the accuracy in acquisition of pattern images from degrading due to substances adhered on the belt 24 during position acquisition processing or density acquisition processing.

Specifically, the CPU 81 first determines in S11 whether or not a belt drive condition is satisfied. The belt drive condition is a condition that the printer 1 needs to satisfy in order to start driving the belt 24 to rotate. In this example, the belt drive condition is that the operating unit 90 or the communication unit 92 has received a print command. It is noted that when a print command has been received, the CPU 81 causes the belt 24 to start being driven to rotate in S2 to form images on the sheets 3 based on the print command. If the CPU 81 determines that the belt drive condition has not been satisfied (S11: NO), the CPU 81 terminates this cleaning-and-correction control processing. Then, the CPU 81 starts the cleaning-and-correction control processing again after a prescribed period of time has passed. On the other hand, if the CPU 81 determines that the belt drive condition has been satisfied (S11: YES), in S12 the CPU 81 determines whether or not at least one of the position acquisition execution condition and the density acquisition execution condition is satisfied.

(1) If Neither the Position Acquisition Execution Condition Nor the Density Acquisition Execution Condition is Satisfied If the CPU 81 determines that neither the position acquisition execution condition nor the density acquisition execution condition is satisfied (S12: NO), the CPU 81 next determines in S13 whether or not at least one of the conditions A and C is satisfied. As described already, the condition A is part of the position pre-execution condition, and is a condition that the printed sheet count $\alpha$ becomes greater than or equal to the position pre-execution threshold $\alpha$ths. The condition C is part of the density pre-execution condition, and is a condition that the humidity $\beta$ becomes greater than or equal to the density pre-execution threshold $\beta$ths. In this way, the CPU 81 determines whether or not at least one from among: the part of the position pre-execution condition; and the part of the density pre-execution condition, is satisfied. Specifically, the CPU 81 determines in S13 whether at least one of the printed sheet count $\alpha$ and the humidity $\beta$ becomes greater than or equal to the corresponding pre-execution threshold $\alpha$ths or $\beta$ths. The processing in S13 is an example of pre-execution condition determination.

(1-1) If at Least One of Conditions a and C is Satisfied

If condition A is satisfied, this signifies that the time to execute the position acquisition processing is approaching, and that the need has arisen to clean the belt 24 beforehand in order to prevent degradation of the accuracy in position acquisition. If condition C is satisfied, this signifies that the time to execute the density acquisition processing is approaching, and that the need has arisen to clean the belt 24 beforehand in order to prevent degradation of the accuracy in density acquisition.

(1-1-1) Cleaning Control Processing

If the CPU 81 determines that at least one of the conditions A and C is satisfied (S13: YES), in S14 the CPU 81 executes a cleaning control processing shown in FIG. 5. In the cleaning control processing, the printer 1 detects the degree of adhesion of substances on the belt 24, in other words how dirty the belt 24 is. The printer 1 then determines, based on the detection results, whether or not the belt 24 should currently be cleaned.

Figure 6:
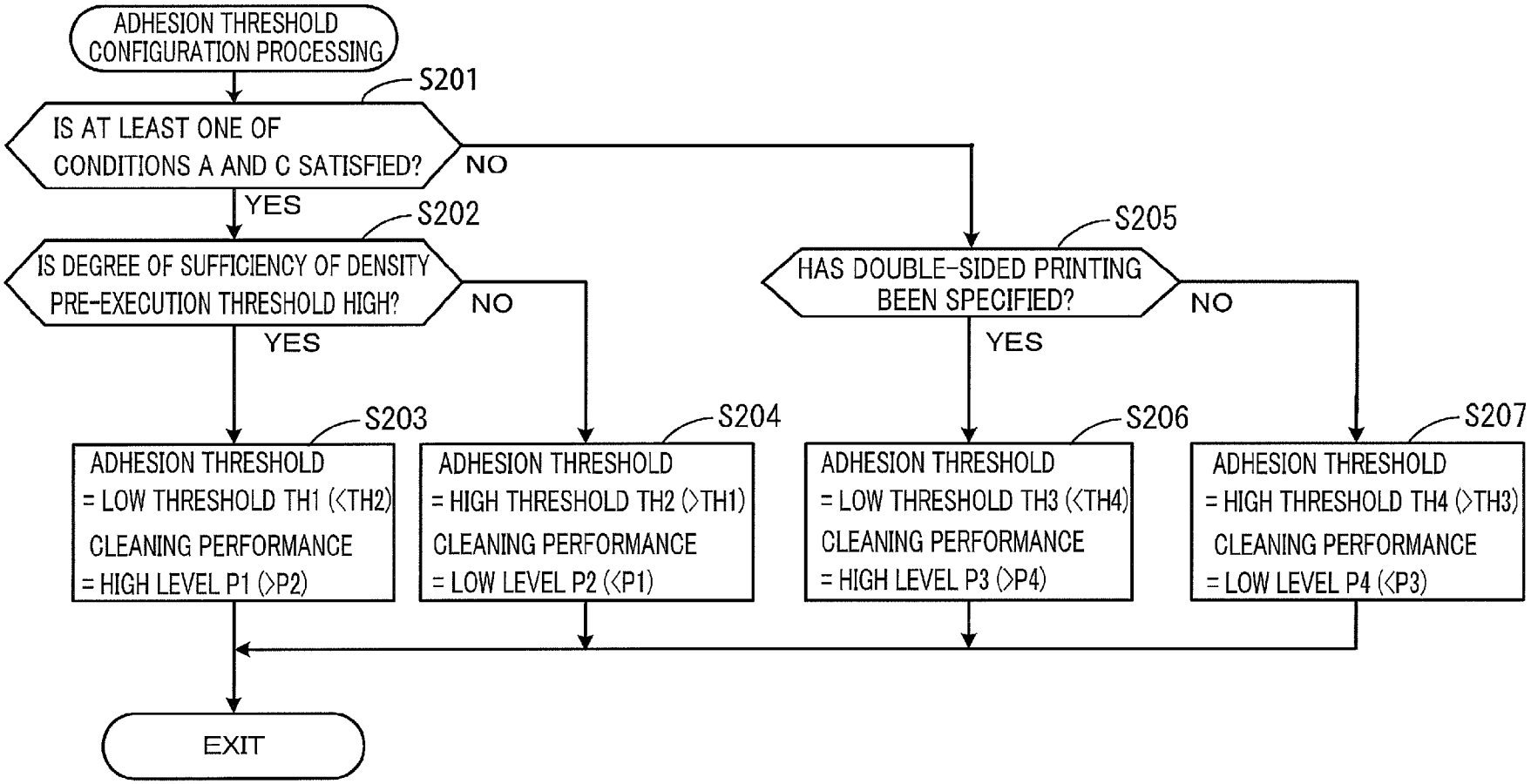
FIG. 6 is a flowchart of an adhesion threshold configuration processing shown in FIG. 5.

More specifically, in S101, the CPU 81 first controls the light projection part 70A of the mark sensor 70 to start emitting light. Then, in S102, the CPU 81 executes a threshold configuration processing to set the adhesion threshold as shown in FIG. 6. The threshold configuration processing will be described later in greater detail.

Next, in S103 the CPU 81 calculates the degree of adhesion based on the amount of light received by the light reception part 70B of the mark sensor 70. It is noted that there is a correlation between the degree of adhesion on the belt 24 and the amount of light received by the light reception part 70B. It is now assumed that as the degree of adhesion of substances on the belt 24 increases, the amount of light received by the light reception part 70B decreases. The CPU 81 can therefore calculate the degree of adhesion based on the amount of light received by the light reception part 70B. In this example, the degree of adhesion is defined by a ratio of the amount of light currently received, with respect to the amount of light that was received when the belt 24 was new. The processing in S103 is an example of detection.

It is noted that the CPU 81 may determine the degree of adhesion based on the amount of light reflected from a single location on the belt 24. However, in order to detect the degree of adhesion on the entire belt 24 with a higher degree of precision, it is preferable for the CPU 81 to determine the degree of adhesion based on the amounts of light reflected from multiple locations on the belt 24. That is, the CPU 81 may determine the degree of adhesion based on: an average value; a maximum value; or an intermediate value between the maximum value and a minimum value, of the amounts of light that have been reflected from the multiple locations on the belt 24. Alternatively, the CPU 81 may determine the degree of adhesion based on the amounts of light that have been received from the belt 24 during a time period in which the belt 24 rotates a prescribed amount, such as a single rotation. That is, the CPU 81 may determine the degree of adhesion based on: an average value; a maximum value; or an intermediate value between the maximum value and a minimum value, of the amounts of light that have been received during the time period.

In S104, the CPU 81 determines whether or not the calculated degree of adhesion exceeds the adhesion threshold that has been set in S102. In other words, in S104, the CPU 81 determines whether the condition B is satisfied. The condition B is remaining part of the position pre-execution condition that is other than the condition A. The condition B is also remaining part of the density pre-execution condition that is other than the condition C. It is noted that the adhesion threshold is such a value that is no higher than a prescribed highest allowable adhesion degree. The highest allowable adhesion degree is a prescribed highest value among all the degrees of adhesion that do not substantially affect the position acquisition processing or the density acquisition processing. The processing in S104 is an example of pre-execution condition determination. The adhesion threshold is an example of a reference adhesion degree.

If the CPU 81 determines that the calculated degree of adhesion exceeds the adhesion threshold (S104: YES), in S107 the CPU 81 turns on the cleaning unit 60 by applying to the cleaning roller 61 the first cleaning voltage of the first target level and applying to the recovery roller 62 the second cleaning voltage of the second target level. It is noted that before the processing of S107 is executed, the cleaning roller 61 and the recovery roller 62 are applied with no electric voltage. Thus, in S107, the CPU 81 brings the cleaning unit 60 from the state, in which the cleaning unit 60 is unable to electrically recover the adhered substances from the belt 24, into another state, in which the cleaning unit 60 is able to electrically recover the adhered substances from the belt 24. In this way, in S107, cleaning performance of the cleaning unit 60 is enhanced to such a level that is higher than a level that the cleaning unit 60 possessed before the belt 24 started to be driven to rotate.

In addition, in S107 the CPU 81 starts tracking or measuring the length of time during which the cleaning unit 60 has been turned on, in order to determine the total length of time during which the cleaning unit 60 has been turned on since the printer 1 was new, that is, since the printer 1 was shipped. This total time is referred to simply as the cleaning-on time. The processing in S107 is an example of cleaning.

After the cleaning unit 60 is turned on in S107, the CPU 81 determines in S108 whether or not a belt stop condition is satisfied. The belt stop condition is a condition that the printer 1 needs to satisfy in order to stop driving the belt 24 to rotate. In this example, the belt stop condition is that the print processing in S3 in FIG. 3 has completed. If the CPU 81 determines that the belt stop condition has not been satisfied (S108: NO), this means that the belt 24 is continuing to be driven to rotate, so the CPU 81 returns to S103. If the CPU 81 then determines that the calculated degree of adhesion does not exceed the adhesion threshold (S104: NO), in S105 the CPU 81 turns off the cleaning unit 60 by stopping application of the first and second cleaning voltages to the cleaning roller 61 and recovery roller 62. In other words, the CPU 81 brings the cleaning unit 60 into a state in which the cleaning unit 60 is unable to electrically recover the adhered substances from the belt 24. In this way, as long as the belt 24 is rotating, the CPU 81 keeps the cleaning unit 60 turned on until the degree of adhesion becomes lower than or equal to the adhesion threshold.

On the other hand, if the CPU 81 determines that the belt stop condition is satisfied (S108: YES), in S105 the CPU 91 turns off the cleaning unit 60. In this way, when the rotation of the belt 24 has been stopped, the CPU 81 turns off the cleaning unit 60 even if the degree of adhesion has not become smaller than or equal to the adhesion threshold. The cleaning unit 60 is kept turned on only while the belt 24 is rotating for the purpose of the print processing.

The above-described configuration can avoid driving the belt 24 to rotate for the sole purpose of cleaning. It is conceivable to drive the belt 24 to rotate for the sole purpose of cleaning. In comparison with this conceivable configuration, the configuration of the present embodiment can reduce such opportunities that the belt 24 and the cleaning roller 61 rub against each other. The configuration of the present embodiment can therefore restrain deterioration of both of the belt 24 and the cleaning roller 61.

Even if at least one of the conditions A and C is satisfied (S13: YES), if the condition B is not satisfied (S104: NO), then this means ultimately that neither the position pre-execution condition (A plus B) nor the density pre-execution condition (C plus B) is satisfied. Accordingly, the CPU 81 proceeds to S106 with the cleaning unit 60 kept turned off. This configuration can prevent the cleaning unit 60 from performing cleaning unnecessarily when the degree of adhesion on the belt 24 is low. This configuration can therefore restrain deterioration of the cleaning unit 60.

In S106, the CPU 81 stops the light projection part 70A from emitting light, and terminates the cleaning control processing and the cleaning-and-correction control processing. In the above-described configuration, the light projection part 70A is controlled to emit light only while the cleaning control processing is executed. However, the light projection part 70A may be configured to emit light continuously at all the time. That is, the light projection part 70A may be configured to emit light not only while the cleaning control processing is executed but also while the cleaning control processing is not executed. However, deterioration of the light projection part 70A can be prevented by controlling the light projection part 70A to emit light only while the cleaning control processing is executed.

(1-1-2) Adhesion Threshold Configuration Processing

The adhesion threshold configuration processing of S102 is for configuring or setting the adhesion threshold that is used in S104. Specifically, as shown in FIG. 6, the CPU 81 first determines in S201 whether or not at least one of the conditions A and C is satisfied. Specifically, the CPU 81 determines in S201 whether at least one of the printed sheet count $\alpha$ and the humidity $\beta$ becomes greater than or equal to the corresponding pre-execution threshold $\alpha$ths or $\beta$ths. If the CPU 81 determines that at least one of the conditions A and C is satisfied (S201: YES), the CPU 81 then determines in S202 whether or not a degree of sufficiency of the density pre-execution threshold is higher than a degree of sufficiency of the position pre-execution threshold. In other words, the CPU 81 determines whether the need to execute density acquisition processing is greater than the need to execute position acquisition processing. The degree of sufficiency of the density pre-execution threshold will be referred to simply as "density-related sufficiency degree" hereinafter. The degree of sufficiency of the position pre-execution threshold will be referred to simply as "position-related sufficiency degree" hereinafter.

The density-related sufficiency degree is defined as a relative amount of the humidity $\beta$ with respect to the density pre-execution threshold $\beta$ths. It is noted that the humidity $\beta$ is correlated with the density deviation of images formed by the image forming section 30. More specifically, the density-related sufficiency degree may be defined as a sufficiency ratio obtained by dividing the humidity $\beta$ by the density pre-execution threshold $\beta$ths ($=\beta/\beta ths$), or as a sufficiency difference obtained by subtracting the density pre-execution threshold $\beta$ths from the humidity $\beta$ ($=\beta-\beta ths$). It is noted that the density-related sufficiency degree being high indicates that execution of density acquisition processing is highly necessary.

The position-related sufficiency degree is defined as a relative amount of the printed sheet count $\alpha$ with respect to the position pre-execution threshold $\alpha$ths. It is noted that the printed sheet count $\alpha$ is correlated with the position deviation of images formed by the image forming section 30. More specifically, the position-related sufficiency degree may be defined as a sufficiency ratio obtained by dividing the printed sheet count $\alpha$ by the position pre-execution threshold $\alpha$ths ($=\alpha/\alpha ths$), or as a sufficiency difference obtained by subtracting the position pre-execution threshold $\alpha$ths from the printed sheet count $\alpha$ ($=\alpha-\alpha ths$). It is noted that the position-related sufficiency degree being high indicates that execution of position acquisition processing is highly necessary.

If the CPU 81 determines that the density-related sufficiency degree is higher than the position-related sufficiency degree (S202: YES), in S203 the CPU 81 sets the adhesion threshold to a low threshold TH1. It is noted that the low threshold TH1 is lower than the highest allowable adhesion degree. Also in S203 the CPU 81 sets to a high level P1 the cleaning performance level to which the cleaning performance of the cleaning unit 60 should be enhanced in S107. The high level P1 is higher than the cleaning performance level that the cleaning unit 60 possessed before the belt 24 started to be driven to rotate. Specifically, the CPU 81 sets the absolute values of the first and second target levels to relatively high values that can enable the cleaning unit 60 to attain the cleaning performance of high level P1.

Conversely, if the CPU 81 determines that the density-related sufficiency degree is not higher than the position-related sufficiency degree (S202: NO), in S204 the CPU 81 sets the adhesion threshold to a high threshold TH2 that is higher than the low threshold described above (TH2>TH1). It is noted that the high threshold TH2 is also lower than the highest allowable adhesion degree. Also in S204 the CPU 81 sets to a low level P2 the cleaning performance level to which the cleaning performance of the cleaning unit 60 should be enhanced in S107. The low level P2 is lower than the high level P1 (P2<P1), but is still higher than the cleaning performance level that the cleaning unit 60 possessed before the belt 24 started to be driven to rotate. Specifically, the CPU 81 sets the absolute values of the first and second target levels to such values that can enable the cleaning unit 60 to attain the cleaning performance of low level P2. It is noted that the absolute values of the first and second target levels necessary to attain the cleaning performance of low level P2, are respectively smaller than the absolute values of the first and second target levels necessary to attain the cleaning performance of high level P1.

In general, the acquisition accuracy of image densities is more strongly affected by substances adhered onto the belt 24 than is the acquisition accuracy of image positions. That is, normally, toner adheres thinly over the entire belt 24, and the absolute value of the amount of light received by the light receiving part 70B of the mark sensor 70 varies accordingly. The position acquisition processing involves for example detecting both ends of a mark in the direction of motion of the belt 24, and taking the position in the center of those ends to be the position of the mark (position detection operation). For this reason, provided that the ends of the mark can be detected, the effects due to variations in the absolute value of the amount of light received are relatively small. In contrast, image densities vary directly in accordance with the amount of light received, and thus the effects due to variations in the absolute value of the amount of light received are relatively large.

In light of this, the CPU 81 sets the adhesion threshold for the case where the density-related sufficiency degree is higher than the position-related sufficiency degree, to be lower than that for the case where the position-related sufficiency degree is higher than the density-related sufficiency degree. As a result, when there is a great need to execute density acquisition processing, the belt 24 will be cleaned by the cleaning unit 60 even if the degree of adhesion of substances on the belt 24 is relatively low. It is noted that another configuration is conceivable in which the adhesion threshold is uniform regardless of the relative magnitudes of the density-related sufficiency degree and the position-related sufficiency degree. In comparison with this comparative configuration, the configuration of the present embodiment can prevent the acquisition accuracy of image densities from being degraded due to substances adhered to the belt 24.

In addition, the CPU 81 sets the cleaning performance for the case where the density-related sufficiency degree is higher than the position-related sufficiency degree, to be higher than that for the case where the position-related sufficiency degree is higher than the density-related sufficiency degree. It is noted that another configuration is conceivable in which the cleaning performance is enhanced to the same level regardless of the position-related sufficiency degree and the density-related sufficiency degree. In comparison with this conceivable configuration, the configuration of the present embodiment can clean the belt 24 with an appropriate cleaning performance that is not excessive nor insufficient.

If the CPU 81 determines that neither condition A nor C is satisfied (S201: NO), in S205 the CPU 81 then determines, based on the print conditions information contained in the print command, whether or not double-sided printing has been specified. If the CPU 81 determines that double-sided printing has been specified (S205: YES), in S206 the CPU 81 sets the adhesion threshold to a low threshold TH3. It is noted that the low threshold TH3 is also lower than the highest allowable adhesion degree. Also in S206 the CPU 81 sets to a high level P3 the cleaning performance level to which the cleaning performance of the cleaning unit 60 should be enhanced in S107. The high level P3 is higher than the cleaning performance level that the cleaning unit 60 possessed before the belt 24 started to be driven to rotate. Specifically, the CPU 81 sets the absolute values of the first and second target levels to relatively high values that can enable the cleaning unit 60 to attain the cleaning performance of high level P3. The low threshold TH3 may be the same as or different from the low threshold TH1. The high level P3 may be the same as or different from the high level P1.

Conversely, if the CPU 81 determines that double-sided printing has been not specified, i.e. that single-sided printing has been specified (S205: NO), in S207 the CPU 81 sets the adhesion threshold to a high threshold TH4 that is higher than the low threshold (TH4>TH3). It is noted that the high threshold TH3 is also lower than the highest allowable adhesion degree. Also in S207 the CPU 81 sets to a low level P4 the cleaning performance level to which the cleaning performance of the cleaning unit 60 should be enhanced in S107. The low level P4 is lower than the high level P3 (P4<P3), but is still higher than the cleaning performance level that the cleaning unit 60 possessed before the belt 24 started to be driven to rotate. Specifically, the CPU 81 sets the absolute values of the first and second target levels to such values that can enable the cleaning unit 60 to attain the cleaning performance of low level P4. It is noted that the absolute values of the first and second target levels necessary to attain the cleaning performance of low level P4, are respectively smaller than the absolute values of the first and second target levels necessary to attain the cleaning performance of high level P3. The high threshold TH4 may be the same as or different from the low threshold TH2. The low level P4 may be the same as or different from the low level P2. After executing one of the steps from S203 to S207, the CPU 81 terminates the adhesion threshold configuration processing and proceeds to S103 in FIG. 5.

In double-sided printing, after an image has been formed on a first side of a sheet 3 and while an image is being formed on a second side, the first side of the sheet 3 faces downward and contacts with the belt 24. For this reason, so-called back surface stain may occur, in which substances adhered on the belt 24 have an adverse effect on the image formed on the first side. In light of this, the CPU 81 sets the adhesion threshold for the case where double-sided printing has been specified, to be lower than that for the case where single-sided printing has been specified. As a result, if double-sided printing has been specified, the belt 24 will be cleaned by the cleaning unit 60 even if the degree of adhesion of substances on the belt 24 is relatively low. In addition, the CPU 81 sets cleaning performance for the case where double-sided printing has been specified, to be higher than that for the case where single-sided printing has been specified. This configuration can prevent back surface stain from occurring during double-side printing.

(1-2) If Neither Condition A Nor C is Satisfied

In FIG. 4, if the CPU 81 determines that neither condition A nor C is satisfied (S13: NO), this signifies that the need to execute position acquisition processing and density acquisition processing is low. It is noted, however, that if a degree of deterioration of the cleaning unit 60 is relatively high, when the cleaning unit 60 is turned on later in S107, the cleaning performance of the cleaning unit 60 will be too low to clean the belt 24 sufficiently.

In light of this, if the CPU 81 determines that neither condition A nor C is satisfied (S13: NO), the CPU 81 acquires in S15 the current humidity β based on the detection results of the humidity sensor 71. The CPU 81 sets a deterioration threshold in S16. The CPU 81 then determines in S17 whether or not the degree of deterioration in the cleaning unit 60 exceeds the deterioration threshold. It is noted that the cleaning unit 60 progressively deteriorates as the total number of rotations of the cleaning roller 61, which have occurred since the printer 1 was new, increases, or as the cleaning-on time, which has been tracked since the printer 1 was new, increases. Consequently, the degree of deterioration of the cleaning unit 60 can be calculated based on: the number of rotations of the cleaning roller 61 that have occurred since the printer 1 was new; or the cleaning-on time of the cleaning roller 61 that has been measured since the printer 1 was new. The processing in S17 is an example of deterioration determination.

In this example, the CPU 81 calculates the degree of deterioration in the cleaning unit 60 based on the number of rotations of the belt 24 counted in S2, or on the cleaning-on time tracked in S107. It is noted that in the printer 1, the belt 24 and the cleaning roller 61 are in continuously contact with each other. Accordingly, there is a correlation between the number of rotations of the belt 24 and the number of rotations of the cleaning roller 61.

If the CPU 81 determines that the degree of deterioration of the cleaning unit 60 does not exceed the deterioration threshold (S17: NO), the CPU 81 terminates the cleaning-and-correction control processing without executing the cleaning control processing.

If, on the other hand, the CPU 81 determines that the degree of deterioration of the cleaning unit 60 exceeds the deterioration threshold (S17: YES), the CPU 81 executes the cleaning control processing in S14 even though the need to execute the position acquisition processing or the density acquisition processing is low. As a result, even though the pre-execution condition is not yet satisfied (no in S13), if the degree of adhesion on the belt 24 exceeds the adhesion threshold (S104: YES), the cleaning unit 60 is turned on in S107 to clean the belt 24. This processing in S107 is an example of deterioration-time cleaning.

The amount of substances that the cleaning unit 60 can remove from one circumferential length of the belt 24 decreases due to the deterioration of the cleaning unit 60. In light of this, the configuration of the present embodiment enables the cleaning unit 60 to clean the belt 24 before the pre-execution condition is satisfied. So, it can be expected that even though the degree of deterioration in the cleaning unit 60 has already exceeded the deterioration threshold, the cleaning results that can be achieved by this cleaning unit 60 are equivalent to those that were achieved by the cleaning unit 60 when the degree of deterioration did not exceed the deterioration threshold. It is noted that another configuration is conceivable in which even though the degree of deterioration in the cleaning unit 60 exceeds the deterioration threshold, the belt 24 is not cleaned until the pre-execution condition is satisfied. In comparison with the conceivable configuration, the configuration of the embodiment can prevent the cleaning unit 60 from failing to remove adhered substances from the belt sufficiently.

It is noted that in S16 the CPU 81 sets the deterioration threshold such that the deterioration threshold decreases as the current humidity β decreases.

In general, if humidity becomes low, fluidity of toner increases. As a result, toner more readily leaks from the toner accommodating chamber 36, and substances more readily adhere to the belt 24. In light of this, the CPU 81 sets the deterioration threshold such that the lower the current humidity β, the lower the deterioration threshold. With this configuration, if toner leaks from the toner accommodating chamber 36 and the quantity of substances adhering to the belt 24 increases, the belt 24 is cleaned before the pre-execution condition is satisfied. Accordingly, it can be expected that even though the degree of deterioration in the cleaning unit 60 has already exceeded the deterioration threshold, the cleaning results that can be achieved by this cleaning unit 60 are equivalent to those that were achieved by the cleaning unit 60 when the degree of deterioration did not exceed the deterioration threshold.

Or, the CPU 81 may set in S16 the deterioration threshold such that the deterioration threshold decreases as the number of rotations of the belt 24, which have occurred since the cleaning unit 60 was last turned off, increases. It is noted that as the number of rotations of the photosensitive bodies 40 increases, the process unit 33 deteriorates. As a result, toner more readily leaks from the toner accommodating chamber 36, and substances more readily adhere to the belt 24. It is noted that in the printer 1, the photosensitive bodies 40 are in continuously contact with the belt 24, so there is a correlation between the number of rotations of the photosensitive bodies 40 and the number of rotations of the belt 24. In light of this, the CPU 81 may set the deterioration threshold such that the deterioration threshold decreases as the number of rotations of the belt 24 which have occurred since the cleaning unit 60 was last turned off increases. It can therefore be said that the CPU 81 may set the deterioration threshold such that the deterioration threshold decreases as the number of rotations of the photosensitive bodies 40 which have occurred since the cleaning unit 60 was last turned off increases.

With this configuration, if toner leaks from the toner accommodating chamber 36 due to deterioration of the process unit 33, and a larger quantity of substances adheres to the belt 24, the belt 24 is cleaned before the pre-execution condition is satisfied. Accordingly, it can be expected that even though the degree of deterioration in the cleaning unit 60 has already exceeded the deterioration threshold, the cleaning results that can be achieved by this cleaning unit 60 are equivalent to those that were achieved by the cleaning unit 60 when the degree of deterioration did not exceed the deterioration threshold. The time at which the cleaning unit 60 was last turned off is an example of a reference time.

(2) If at Least One of the Position Acquisition Execution Condition and Density Acquisition Execution Condition is Satisfied If the CPU 81 determines that at least one of the position acquisition execution condition and density acquisition execution condition is satisfied (S12: YES), the CPU 81 determines in S20 whether or not the density acquisition execution condition is satisfied.

(2-1) Position Acquisition Processing

If the CPU 81 determines that the density acquisition execution condition is not satisfied, i.e. that the position acquisition execution condition is satisfied (S20: NO), in S21 and S22 the CPU 81 executes the position acquisition processing. That is, in S21 the CPU 81 causes the image forming section 30 to form the pattern for position acquisition on the belt 24. More specifically, the CPU 81 reads position correction values and density correction values, which have been set most recently and are stored in the nonvolatile memory 85. The density correction values include gradation correction values (gamma correction values) and bias correction values. The CPU 81 causes the image forming section 30 to form the pattern for position acquisition, while correcting image forming positions and image densities of the pattern according to the most-recently set position correction values and density correction values that are stored in the nonvolatile memory 85. That is, the CPU 81 corrects the image forming positions by correcting the timings of exposure onto the photosensitive bodies 40 by the exposure units 32 based on the position correction values. The CPU 81 corrects the image densities of the pattern by changing gradations in image data for the pattern based on the gradation correction values and by changing the developing bias values applied to the developing rollers 38 based on the bias correction values.

In the pattern for position acquisition, a plurality of marks are arrayed in the sub scanning direction and are separated from each other by an interval in the sub scanning direction. Each mark is longer in the main scanning direction than in the sub scanning direction. The plurality of marks are divided into several groups of marks such that the groups are arranged in the sub scanning direction and are separated from each other by an interval in the sub scanning direction. In each group, four marks of black, yellow, magenta, and cyan are arranged in this order.

After having started to form the pattern for position acquisition on the belt 24, in S22 the CPU 81 causes the mark sensor 70 to execute the position detection operation described above, and acquires information related to positions of respective marks based on the detection results. Specifically, based on signals from the mark sensor 70, the CPU 81 detects timings at which the respective marks pass the detection location X of the mark sensor 70. Then, based on the detected timings, the CPU 81 acquires positional shift amounts in the sub scanning direction of the marks for colors other than black (hereafter referred to as correction colors), relative to the black marks whose positions are used as a reference.

After acquiring the positional shift amounts for all groups of marks, the CPU 81 calculates an average value, across all groups of marks, of the positional shift amounts for each correction color. The CPU 81 then in S23 updates the position correction value stored in the nonvolatile memory 85 for each correction color by adding to the position correction value such a value that serves to cancel out a positional deviation (color registration deviation) that is a difference between the average value and a reference shift amount for the correction color. The reference shift amount for each correction color is a positional shift amount between a black mark and a mark of the correction color in an ideal case in which no positional deviation occurs. The CPU 81 then terminates the cleaning-and-correction control processing.

(2-2) Density Acquisition Processing

If the CPU 81 determines that the density acquisition execution condition is satisfied (S20: YES), in S24 and S25 the CPU 81 executes density acquisition processing. Specifically, in S24 the CPU 81 causes the image forming section 30 to form the pattern for density acquisition on the belt 24, while correcting the image forming positions and image densities based on the most-recently set position correction values and density correction values that are stored in the nonvolatile memory 85. In the pattern for density acquisition, a plurality of marks are arrayed in the sub scanning direction and are separated from each other by an interval in the sub scanning direction. Each mark has a substantially rectangular shape. The pattern for density acquisition is configured from four gradation patterns each for one color. Each gradation pattern is composed of several marks whose image densities progressively change by a prescribed density interval (for example, 20%).

After having started to form the pattern for density acquisition on the belt 24, in S25 the CPU 81 acquires information related to the image densities of the respective marks based on the detection results of the sensor 70. Specifically, based on signals from the mark sensor 70, the CPU 81 detects the amount of light reflected from the belt 24 when each mark passes the detection location X of the mark sensor 70. Based on the detection results, the CPU 81 acquires the image densities of each gradation pattern.

After having acquired the image densities for all the marks, in S26 the CPU 81 updates the bias correction value stored in the nonvolatile memory 85 for each color by modifying the bias correction value such that an image density value detected for a mark having an image density of 100% will become a predetermined ideal density value. Also in S26 the CPU 81 updates the gradation correction value stored in the nonvolatile memory 85 for each color by modifying the gradation correction value such that the changing characteristics of the image densities in the gradation pattern will approach such ideal image density characteristics which are faithful to an image corresponding to image data contained in the print command. The CPU 81 then terminates the cleaning-and-correction control processing.

Effects of the Present Embodiment

Figure 7:
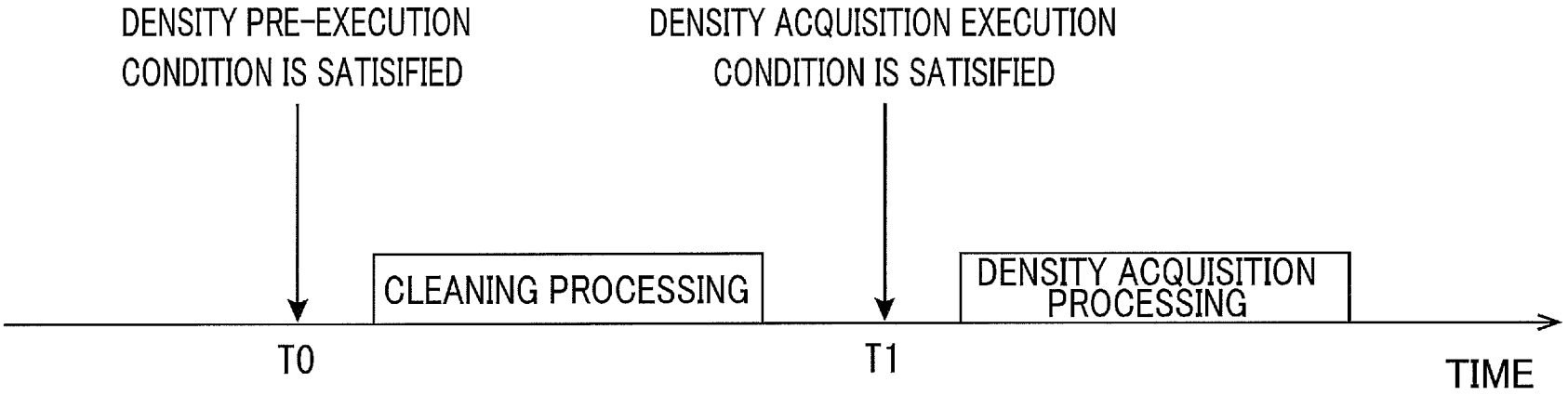
FIG. 7 is a timing chart showing relationship between when a density pre-execution condition is satisfied and when a density acquisition execution condition is satisfied.

Now assume that the density pre-execution condition is satisfied at a time T0 as shown in FIG. 7. According to the present embodiment, therefore, at the time T0, cleaning performance of the cleaning unit 60 is increased and the belt 24 is cleaned by the cleaning unit 60 with the enhanced cleaning performance. Thereafter, at time T1, the density acquisition execution condition is satisfied. Accordingly, at the time T1, the density acquisition processing is executed by using the belt 24 which has already been cleaned. The acquisition accuracy of image densities can be restrained from being degraded due to substances adhered to the belt 24. It is noted that another configuration is conceivable in which, at the time T1 when the density acquisition execution condition is satisfied, the belt 24 is cleaned and then density acquisition processing is executed. However, in comparison with this conceivable configuration, the configuration of the present embodiment can execute the density acquisition processing more quickly after the density acquisition execution condition is satisfied.

Other Embodiments

While the invention has been described in detail with reference to the embodiment thereof, it would be apparent to those skilled in the art that various changes and modifications may be made therein without departing from the spirit of the invention.

For example, the present invention can be applied not only to the direct-to-paper transfer tandem type printers, but also to printers of other various types, such as, intermediate transfer type printers, and 4-cycle transfer type printers. In these printers, photosensitive bodies bear thereon electrostatic images and toner images, and therefore are examples of a bearing body, and developing units, charging units, and exposure units are examples of an image forming section.

The present invention can be applied also to printers of other types, such as printers of a multi-transfer, intermediate transfer type, which employs an intermediate transfer body and is of a tandem type. In these printers, intermediate transfer bodies and photosensitive bodies bear thereon electrostatic images and toner images, and therefore are examples of a bearing body, and developing units, charging units, and exposure units are examples of an image forming section.

In addition, the present invention can be applied to electrophotographic printers of other types, such as of a polygon scanning type. The present invention can be applied to printers of other types, such as inkjet printers.

The present invention can be applied to such a printer whose image forming section can perform single-sided printing only. The present invention can be applied also to such a printer whose image forming section can perform monochrome printing only.

The cleaning unit 60 may be configured to physically recover substances adhered to the belt 24. For example, the cleaning unit 60 may have a blade which serves as a contact body that can contact with the surface of the belt 24. The blade is configured to physically scrape off substances adhered onto the belt 24, thereby recovering the adhered substances. According to this configuration, cleaning performance can be enhanced by moving the blade from a state, in which the blade is out of contact with the belt 24, to a state, in which the blade is in contact with the belt 24. Or, cleaning performance can be enhanced by increasing the strength or amount of force with which the blade is pressed against the belt 24.

The detection unit 70 may not be limited to the optical sensor, but may be configured from an image sensing device such as a CCD camera.

In the above-described embodiment, the controller 80 executes the cleaning-and-correction control processing and other processings by using a single CPU and memory. However, the present invention is not limited to this configuration. For example, the controller 80 may execute the cleaning-and-correction control processing and other processings: by using multiple CPUs; by using a hardware circuit such as the ASIC 84 only; or by using a CPU and a hardware circuit. Or, the controller 80 may execute the print control processing by using one CPU and execute the cleaning-and-correction control processing by using another CPU that is different from the CPU that is used to execute the print control processing.

In the embodiment, the printer 1 executes, as the pattern acquisition processing, the position acquisition processing and density acquisition processing. However, the printer 1 may execute, as the pattern acquisition processing, at least one of the processing I and the processing II described below:

<Processing I>

A pattern for detecting positions in the main scanning direction is formed on the belt 24 by the image forming section 30. Positions of this pattern in the main scanning direction are acquired using an optical sensor such as the mark sensor 70.

<Processing II>

A pattern for detecting variations in the rotation speed of the photosensitive bodies 40 is formed on the belt 24 by the image forming section 30. Positions of this pattern, which correspond to the variations in the rotation speed, are acquired using an optical sensor such as the mark sensor 70.

In the embodiment, the printer 1 acquires, as characteristics of a pattern image, the image forming positions in the sub scanning direction of the pattern image and the image densities of the pattern image. However, the printer 1 may acquire, as the characteristics of the pattern image, image forming positions of the pattern image in the main scanning direction, or image sizes (scaling) of the pattern image.

Each of the position acquisition execution condition and the density acquisition execution condition may include at least one of conditions 1 to 6 listed below.

Condition 1: That the cover 2B has been opened at least a prescribed number of times.

The controller 80 can determine whether or not the condition 1 is satisfied, based on detection results of a cover open-close sensor (not shown). The number of times that the cover 2B has opened and closed is an example of a correlation value.

Condition 2: That a prescribed length of time has elapsed since the last time that the pattern acquisition processing (the position acquisition processing or density acquisition processing) was executed.

The length of time, which has elapsed since the last time that the pattern acquisition processing (the position acquisition processing or density acquisition processing) was executed, is an example of a correlation value.

Condition 3: That the temperature within the casing 2 has become higher than or equal to a prescribed temperature.

The controller 80 can determine whether or not the condition 3 is satisfied based on detection results of a temperature sensor (not shown). The temperature within the casing 2 is an example of a correlation value.

Condition 4: That the humidity within the casing 2 has become higher than or equal to a prescribed humidity. The humidity within the casing 2 is an example of a correlation value.

Condition 5: That the total number of sheets 3, which have been printed since the last time that the pattern acquisition processing (the position acquisition processing or density acquisition processing) was executed, has become higher than or equal to a prescribed number. The total number of sheets 3, which have been printed since the last time that the pattern acquisition processing was executed, is an example of a correlation value.

Condition 6: That the total number of rotations of the belt 24 or the photosensitive bodies 40, which have occurred since the last time that the pattern acquisition processing (the position acquisition processing or density acquisition processing) was executed, has become higher than or equal to a prescribed number. The total number of rotations of the belt 24 or the photosensitive bodies 40, which have occurred since the last time that the pattern acquisition processing was executed is an example of a correlation value.

It is sufficient that the correlation value is such a value that is correlated with the amount of deviation in characteristics of images formed by the image forming section 30 from ideal characteristics. Accordingly, the correlation values in the respective conditions 1-6 described above may be converted into point values, and the total of the point values may be used as a correlation value.

The belt drive condition, for which judgment is executed in S11, is not limited to the condition that a print command has been received. Now suppose that the printer 1 is provided with an agitator (not shown) for agitating the toner in the toner accommodating chamber 36 to maintain fluidity of toner. The agitator is configured to rotate in association with the driving rotation of the belt 24. In this case, the belt drive condition may be such a condition that the time to agitate toner in the toner accommodating chamber 36 has arrived. If this condition is satisfied, the belt 24 is started to be driven to rotate. The time to perform toner agitation may be reached when the power is turned on, or when the remaining amount of toner is detected.

The belt drive condition may also be a condition that the time to execute sensitivity adjustment of the mark sensor 70 has arrived. The time to execute the sensitivity adjustment of the mark sensor 70 may be reached when the power is turned on, or when a prescribed amount of time has elapsed since the last time that the sensitivity adjustment was performed. When the time to execute sensitivity adjustment has arrived, the controller 80 starts driving the belt 24 to rotate, and causes the mark sensor 70 to execute light projection onto and light reception from the surface of the belt 24. The controller 80 adjusts sensitivity of the mark sensor 70 by changing the amount of the projected light based on the light reception results.

The belt stop condition, for which judgment is executed in S108, may be a condition that some processing has completed. Or, the belt stop condition may be a condition that an error has occurred due to a sheet being printed has become jammed on the conveyance path or due to there being no sheets 3 loaded in the tray 11.

The first cleaning voltage may be applied to the cleaning roller 61 before the processing in S107 is executed. In such a case, the CPU 81 can enhance the cleaning performance in S107 by increasing the absolute value of the first cleaning voltage.

Or, before the processing of S107 is executed, the cleaning roller 61 may be applied with a voltage whose polarity is such a polarity that is incapable of recovering adhered substances from the belt 24 (positive polarity, for example). In S107, the CPU 81 can enhance the cleaning performance by switching the polarity of the voltage to such a polarity that is capable of recovering the adhered substances (negative polarity, for example).

Or, in S107, the CPU 81 can enhance the cleaning performance by starting to drive the cleaning roller 61 to rotate. Or, in S107, the CPU 81 can enhance the cleaning performance by increasing a length of time during which the cleaning unit 60 is kept being turned on. The length of time during which the cleaning unit 60 is kept being turned on can be increased by lowering the adhesion threshold used in S104, for example.

In the cleaning-and-correction control processing in FIG. 4, the CPU 81 may proceed directly to S12, without executing S11, that is, regardless of whether or not the belt 24 is being driven to rotate.

The position pre-execution condition and the density pre-execution condition may not include condition B. If the CPU 81 determines in S13 that at least one of conditions A and C is satisfied (S13: YES), the CPU 81 may proceed directly to S107 in FIG. 5, without executing S101 to S104, thereby increasing the cleaning performance of the cleaning unit 60.

In the cleaning control processing, after causing the light projection part 70A to start emitting light in S101, the CPU 81 may proceed directly to S103, without performing the adhesion threshold configuration process in S102. That is, the adhesion threshold may be a fixed value.

The CPU 81 may change the adhesion threshold such that the adhesion threshold becomes lowered as the cleaning-on time of the cleaning unit 60 which has been measured since the printer 1 was new increases. Or, CPU 81 may change the adhesion threshold such that the adhesion threshold becomes lowered as the numbers of rotations of the belt 24 and the cleaning roller 61 which have occurred since the printer 1 was new increase. This is because as the cleaning-on time of the cleaning unit 60 increases and as the numbers of rotations of the belt 24 and cleaning roller 61 increase, the degree of deterioration in the cleaning roller 61 increases, and the cleaning performance decreases. This modification can cause the cleaning unit 60 to perform cleaning even if the degree of adhesion of substances on the belt 24 is somewhat low. This can restrain the deteriorated cleaning unit 60 from failing to clean the belt 24 sufficiently.

If the CPU 81 determines that the belt stop condition is satisfied (S108: YES), the CPU 81 may set in S105 the cleaning performance of the cleaning unit 60 to such a level that is no higher than the level which the cleaning unit 60 possessed before the belt 24 started to be driven to rotate. Or, the CPU 81 may set in S105 the cleaning performance to such a level that is higher than the level which the cleaning unit 60 possessed before the belt 24 started to be driven to rotate, but lower than the level which the cleaning unit 60 possessed before the belt stop condition became satisfied.

In the cleaning control processing, after turning on the cleaning unit 60 in S107, the CPU 81 may proceed directly to S103, without executing the process of S108. In other words, the CPU 81 may turn on the cleaning unit 60 if the belt drive condition is satisfied, and keep the cleaning unit 60 on until the degree of adhesion becomes smaller than or equal to the adhesion threshold, regardless of whether the belt 24 is rotating or not.

In the adhesion threshold configuration processing, the CPU 81 may execute only one of the decision steps S202 and S205. For example, the CPU 81 may skip the decision step S201 and proceed directly to either S202 or S205, regardless of whether or not at least one of the conditions A and C is satisfied. Or, instead of executing the process of S201, the CPU 81 may determine which of the conditions A and C is satisfied. The CPU 81 may proceed to S204 if only condition A is satisfied. The CPU 81 may proceed to S203 if only condition C is satisfied.

In each of S203 and S206 in FIG. 6, the CPU 81 may execute only one from among: the setting to set the adhesion threshold to the low threshold TH1 or TH3; and the setting to set the cleaning performance level to the high level P1 or P3.

Similarly, in each of S204 and S207 in FIG. 6, the CPU 81 may execute only one from among: the setting to set the adhesion threshold to the high threshold TH2 or TH4; and the setting to set the cleaning performance level to the low level P2 or P4.

The printer 1 may be configured such that the photosensitive bodies 40 can be separated away from the belt 24. In such a case, it is preferable that the CPU 81 individually detects: the number of rotations of the photosensitive bodies 40 which have occurred since the last time that the cleaning unit 60 was turned off; and the number of rotations of the belt 24 which have occurred since the last time that the cleaning unit 60 was turned off. The CPU 81 may set the deterioration threshold such that the higher the rotation numbers, the lower the deterioration threshold.

In S16 in FIG. 4, the CPU 81 may set the deterioration threshold based on at least one of: the humidity; the number of rotations of the photosensitive bodies 40 which have occurred since the last time that the cleaning unit 60 was turned off; and the number of rotations of the belt 24 which have occurred since the last time that the cleaning unit 60 was turned off. Or, the CPU 81 may skip the processing of S16. That is, the deterioration threshold may be a fixed value.

The condition "the correlation value becomes higher than or equal to the execution threshold" means that the absolute value of the correlation value becomes higher than or equal to the absolute value of the execution threshold. For example, the correlation value and the execution threshold may both be negative values. In such a case, the condition "the correlation value becomes higher than or equal to the execution threshold" includes such a condition that the correlation value becomes lower than or equal to the execution threshold. Similarly, the condition "the correlation value becomes higher than or equal to the pre-execution threshold" means that the absolute value of the correlation value becomes higher than or equal to the absolute value of the pre-execution threshold. For example, the correlation value and the pre-execution threshold may both be negative values. In such a case, the condition "the correlation value becomes higher than or equal to the pre-execution threshold" includes such a condition that the correlation value becomes lower than or equal to the pre-execution threshold.

"A pre-execution threshold lower than the execution threshold" means a pre-execution threshold whose absolute value is less than that of the execution threshold. Thus, if the execution threshold and the pre-execution threshold are both negative, the pre-execution threshold is higher than the execution threshold.

What is claimed is:

1. An image forming apparatus comprising:

a bearing body;

an image forming section configured to form an image on the bearing body;

a detection unit configured to output detection results that correspond to a state of a surface of the bearing body;

a cleaning unit configured to clean the bearing body, the cleaning unit being configured to be brought into a first state and a second state different from the first state, the cleaning unit in the first state attaining a first cleaning performance level, the cleaning unit in the second state attaining a second cleaning performance level that is higher than the first cleaning performance level; and a control device configured to:

execute a pre-execution condition determination to determine whether a pre-execution condition is satisfied;

when it is determined that the pre-execution condition is satisfied, bring the cleaning unit from the first state into the second state and control the cleaning unit to clean the bearing body;

execute an execution condition determination to determine whether an execution condition is satisfied; and when it is determined that the execution condition is satisfied, execute a pattern acquisition for forming a pattern image on the bearing body by using the image forming section and acquiring characteristics of the pattern image based on detection results that are outputted from the detection unit by detecting the pattern image, the pre-execution condition including a condition that a correlation value satisfies a first condition, the correlation value being correlated with an amount of deviation in characteristics of images formed by the image forming section, the execution condition including a condition that the correlation value satisfies a second condition, the correlation value satisfying the first condition before satisfying the second condition, in the pre-execution condition determination, the control device is configured to determine whether at least one of a position pre-execution condition and a density pre-execution condition is satisfied, the position pre-execution condition includes a condition that a position correlation value satisfies a first position-related condition, the density pre-execution condition includes a condition that a density correlation value satisfies a first density-related condition, the control device is configured to bring the cleaning unit from the first state into the second state when it is determined that at least one of the density pre-execution condition and the position pre-execution condition is satisfied, the second cleaning performance level of the second state, into which the control device brings the cleaning unit when it is determined that the density pre-execution condition is satisfied, is higher than the second cleaning performance level of the second state, into which the control device brings the cleaning unit when it is determined that the position pre-execution condition is satisfied, in the execution condition determination, the control device is configured to determine whether at least one of a position acquisition execution condition and a density acquisition execution condition is satisfied, the control device is configured to execute a position acquisition as the pattern acquisition when it is determined that the position acquisition execution condition is satisfied and to execute a density acquisition as the pattern acquisition when it is determined that the density acquisition execution condition is satisfied, the position acquisition execution condition includes a condition that the position correlation value satisfies a second position-related condition, the density acquisition execution condition includes a condition that the density correlation value satisfies a second density-related condition, the position acquisition being for forming a position acquisition pattern image on the bearing body by using the image forming section and acquiring a position of the position acquisition pattern image based on detection results that are outputted from the detection unit by detecting the position acquisition pattern image, the density acquisition being for forming a density acquisition pattern image on the bearing body by using the image forming section and acquiring an image density of the density acquisition pattern image based on detection results that are outputted from the detection unit by detecting the density acquisition pattern image, the position correlation value being correlated with an amount of deviation in positions of images formed by the image forming section, the density correlation value being correlated with an amount of deviation in densities of images formed by the image forming section, the position correlation value satisfying the first position-related condition before satisfying the second position-related condition, and the density correlation value satisfying the first density-related condition before satisfying the second density-related condition.

2. The image forming apparatus according to claim 1, wherein the bearing body includes a rotating body configured to be driven to rotate, wherein the image forming apparatus further comprises:

a reception unit configured to receive a formation command; and a driving unit configured to drive the rotating body to rotate, and wherein the control device is configured such that when the reception unit receives a formation command, the control device executes an image formation for controlling the driving unit to drive the rotating body to rotate and controlling the image forming section to form images based on the formation command, the control device being configured to bring the cleaning unit into the second state after the driving unit has started driving the rotating body to rotate.

3. The image forming apparatus according to claim 2, wherein:

the control device is configured to control the image forming section and the bearing body to perform both of a single-sided image formation and a double-sided image formation, the single-sided image formation being for forming an image on one side of a sheet conveyed on the bearing body, the double-sided image formation being for forming an image on one side of a sheet conveyed on the bearing body and forming an image on another side of the sheet that is conveyed on the bearing body with its sides being reversed, and the second cleaning performance level of the second state, into which the control device brings the cleaning unit when the formation command specifies the double-sided printing, is higher than the second cleaning performance level of the second state, into which the control device brings the cleaning unit when the formation command specifies the single-sided printing.

4. The image forming apparatus according to claim 1, wherein:

the control device is configured to:

when it is determined that neither the position pre-execution condition nor the density pre-execution condition is satisfied, execute a deterioration determination for determining whether a degree of deterioration of the cleaning unit exceeds a reference deterioration value, and when it is determined that the degree of deterioration exceeds the reference deterioration value, execute a deterioration-time cleaning for bringing the cleaning unit from the first state into the second state and controlling the cleaning unit to clean the bearing body, the deterioration-time cleaning being executed before at least one of the position pre-execution condition and the density pre-execution condition is satisfied.

5. The image forming apparatus according to claim 4, further comprising a humidity detection unit configured to detect humidity, wherein the control device is configured to set the reference deterioration value such that the reference deterioration value decreases as the humidity decreases.

6. The image forming apparatus according to claim 4, wherein the image forming section comprises:

an accommodating part configured to accommodate coloring agent; and an image bearing body configured to rotate while being in contact with the bearing body and to form, as the images, images of the coloring agent on the bearing body, and wherein the control device is configured to set the reference deterioration value such that the reference deterioration value decreases as the number of rotations of the image bearing body, which have occurred since a reference time, increases.

7. The image forming apparatus according to claim 4, wherein:

the bearing body includes a rotating body configured to be driven to rotate, the cleaning unit is in continuous contact with the rotating body, and the control device is configured to set the reference deterioration value such that the reference deterioration value decreases as the number of rotations of the rotating body, which have occurred since a reference time, increases.

8. The image forming apparatus according to claim 1, wherein the cleaning unit in the first state is out of contact with the bearing body, and the cleaning unit in the second state is in contact with the bearing body.

9. The image forming apparatus according to claim 1, wherein:

the cleaning unit in both of the first and second states is in contact with the bearing body, the cleaning unit in the first state is pressed against the bearing body with force of a first amount, and the cleaning unit in the second state is pressed against the bearing body with force of a second amount that is greater than the first amount.

10. The image forming apparatus according to claim 1, wherein the cleaning unit in the first state is applied with no electric voltage, and the cleaning unit in the second state is applied with an electric voltage.

11. An image forming apparatus comprising:

a bearing body;

an image forming section configured to form an image on the bearing body;

a detection unit configured to output detection results that correspond to a state of a surface of the bearing body;

a cleaning unit configured to clean the bearing body, the cleaning unit being configured to be brought into a first state and a second state different from the first state, the cleaning unit in the first state attaining a first cleaning performance level, the cleaning unit in the second state attaining a second cleaning performance level that is higher than the first cleaning performance level; and a control device configured to:

execute a pre-execution condition determination to determine whether a pre-execution condition is satisfied;

when it is determined that the pre-execution condition is satisfied, bring the cleaning unit from the first state into the second state and control the cleaning unit to clean the bearing body;

execute an execution condition determination to determine whether an execution condition is satisfied; and when it is determined that the execution condition is satisfied, execute a pattern acquisition for forming a pattern image on the bearing body by using the image forming section and acquiring characteristics of the pattern image based on detection results that are outputted from the detection unit by detecting the pattern image, the pre-execution condition including a condition that a correlation value satisfies a first condition, the correlation value being correlated with an amount of deviation in characteristics of images formed by the image forming section, the execution condition including a condition that the correlation value satisfies a second condition, the correlation value satisfying the first condition before satisfying the second condition, wherein the control device is configured to execute a detection for detecting a degree of adhesion of substances on the bearing body based on detection results of the detection unit, and wherein the pre-execution condition includes a condition that the correlation value satisfies the first condition and the detected degree of adhesion exceeds a reference adhesion degree.

12. The image forming apparatus according to claim 11, wherein:

in the pre-execution condition determination, the control device is configured to determine whether at least one of a position pre-execution condition and a density pre-execution condition is satisfied, the position pre-execution condition includes a condition that a position correlation value satisfies a first position-related condition and the detected degree of adhesion exceeds a position-related reference adhesion degree, the density pre-execution condition includes a condition that a density correlation value satisfies a first density-related condition and the detected degree of adhesion exceeds a density-related reference adhesion degree, the density-related reference adhesion degree is smaller than the position-related reference adhesion degree, the control device is configured to bring the cleaning unit from the first state into the second state when it is determined that at least one of the density pre-execution condition and the position pre-execution condition is satisfied, in the execution condition determination, the control device is configured to determine whether at least one of a position acquisition execution condition and a density acquisition execution condition is satisfied, the control device is configured to execute a position acquisition as the pattern acquisition when it is determined that the position acquisition execution condition is satisfied and to execute a density acquisition as the pattern acquisition when it is determined that the density acquisition execution condition is satisfied, the position acquisition execution condition includes a condition that the position correlation value satisfies a second position-related condition, the density acquisition execution condition includes a condition that the density correlation value satisfies a second density-related condition, the position acquisition being for forming a position acquisition pattern image on the bearing body by using the image forming section and acquiring a position of the position acquisition pattern image based on detection results that are outputted from the detection unit by detecting the position acquisition pattern image, the density acquisition being for forming a density acquisition pattern image on the bearing body by using the image forming section and acquiring an image density of the density acquisition pattern image based on detection results that are outputted from the detection unit by detecting the density acquisition pattern image, the position correlation value being correlated with an amount of deviation in positions of images formed by the image forming section, the density correlation value being correlated with an amount of deviation in densities of images formed by the image forming section, the position correlation value satisfying the first position-related condition before satisfying the second position-related condition, the density correlation value satisfying the first density-related condition before satisfying the second density-related condition.

13. An image forming apparatus comprising:

a bearing body;

an image forming section configured to form an image on the bearing body;

a detection unit configured to output detection results that correspond to a state of a surface of the bearing body;

a cleaning unit configured to clean the bearing body, the cleaning unit being configured to be brought into a first state and a second state different from the first state, the cleaning unit in the first state attaining a first cleaning performance level, the cleaning unit in the second state attaining a second cleaning performance level that is higher than the first cleaning performance level; and a control device configured to:

execute a pre-execution condition determination to determine whether a pre-execution condition is satisfied;

when it is determined that the pre-execution condition is satisfied, bring the cleaning unit from the first state into the second state and control the cleaning unit to clean the bearing body;

execute an execution condition determination to determine whether an execution condition is satisfied; and when it is determined that the execution condition is satisfied, execute a pattern acquisition for forming a pattern image on the bearing body by using the image forming section and acquiring characteristics of the pattern image based on detection results that are outputted from the detection unit by detecting the pattern image, the pre-execution condition including a condition that a correlation value satisfies a first condition, the correlation value being correlated with an amount of deviation in characteristics of images formed by the image forming section, the execution condition including a condition that the correlation value satisfies a second condition, and the correlation value satisfying the first condition before satisfying the second condition, wherein the correlation value changes such that after having satisfied the first condition, the correlation value continues to satisfy the first condition until the correlation value begins satisfying the second condition.

14. The image forming apparatus according to claim 13, wherein:

it is determined that the correlation value satisfies the first condition when an absolute value of the correlation value becomes higher than or equal to an absolute value of a pre-execution threshold, it is determined that the correlation value satisfies the second condition when the absolute value of the correlation value becomes higher than or equal to an absolute value of an execution threshold, the absolute value of the pre-execution threshold is lower than the absolute value of the execution threshold, and the absolute value of the correlation value changes such that after becoming higher than or equal to the absolute value of the pre-execution threshold, the absolute value of the correlation value remains higher than or equal to the absolute value of the pre-execution threshold until the absolute value of the correlation value becomes higher than or equal to the absolute value of the execution threshold.

* * * * *